US011873817B2

(12) United States Patent
Tsuchiya et al.

(10) Patent No.: US 11,873,817 B2
(45) Date of Patent: Jan. 16, 2024

(54) LIQUID-FEEDING ROTARY-SCREW COMPRESSOR

(71) Applicant: Hitachi Industrial Equipment Systems Co., Ltd., Tokyo (JP)

(72) Inventors: Takeshi Tsuchiya, Tokyo (JP); Kotaro Chiba, Tokyo (JP); Masahiko Takano, Tokyo (JP); Shigeyuki Yorikane, Tokyo (JP); Kenji Morita, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 38 days.

(21) Appl. No.: 17/771,715

(22) PCT Filed: Sep. 10, 2020

(86) PCT No.: PCT/JP2020/034230
§ 371 (c)(1),
(2) Date: Apr. 25, 2022

(87) PCT Pub. No.: WO2021/084925
PCT Pub. Date: May 6, 2021

(65) Prior Publication Data

US 2022/0403845 A1 Dec. 22, 2022

(30) Foreign Application Priority Data

Oct. 30, 2019 (JP) ..... 2019-197820

(51) Int. Cl.
*F01C 1/16* (2006.01)
*F03C 2/00* (2006.01)
(Continued)

(52) U.S. Cl.
CPC ..... *F04C 29/12* (2013.01); *F04C 18/16* (2013.01); *F04C 18/20* (2013.01); *F04C 2250/102* (2013.01)

(58) Field of Classification Search
CPC ..... F04C 18/16; F04C 18/18; F04C 18/20; F04C 28/10; F04C 29/00; F04C 29/12;
(Continued)

(56) References Cited

U.S. PATENT DOCUMENTS 4,560,333 A * 12/1985 Fujiwara ..... F04C 18/16 418/201.3
4,963,079 A * 10/1990 Fujiwara ..... F04C 18/16 418/201.3
(Continued)

FOREIGN PATENT DOCUMENTS

JP 56-165790 A 12/1981
JP 2008-82273 A 4/2008
JP 2015086782 A * 5/2015 ..... F04C 18/16

OTHER PUBLICATIONS

International Preliminary Report on Patentability (PCT/IB/338 & PCT/IB/373) issued in PCT Application No. PCT/JP2020/034230 dated May 12, 2022, Including English translation of document C2 (Japanese-language Written Opinion (PCT/ISA/237), filed on Apr. 25, 2022) (five (5) pages).
(Continued)

*Primary Examiner* — Theresa Trieu
(74) *Attorney, Agent, or Firm* — Crowell & Moring LLP

(57) ABSTRACT

A delivery port of a rotary-screw compressor includes a first opening having a profile configured to interrupt communication with a second working chamber of a suction process that opens only in the axial direction; a second opening connected to the first opening; and a third opening connected to the first and second openings. The profile of the first opening includes a first profile line that forms one of a pair of lateral edges of a lingulate protrusion; a second profile line that forms another one of the pair of the lateral edges of the protrusion; a third profile line that extends toward the reference point along the root circle of the female rotor; and
(Continued)

a second connection line that connects the first and second profile lines. The second opening opens into the first opening at the second connection line. The third opening opens into the first groove.

7 Claims, 15 Drawing Sheets

(51) Int. Cl.

| | |
|---|---|
| ***F03C 4/00*** | (2006.01) |
| ***F04C 2/00*** | (2006.01) |
| ***F04C 29/12*** | (2006.01) |
| ***F04C 18/16*** | (2006.01) |
| ***F04C 18/20*** | (2006.01) |

(58) Field of Classification Search
CPC .. F04C 2250/10; F04C 2250/102; F01C 1/16; F01C 1/18; F01C 1/20
See application file for complete search history.

(56) References Cited

U.S. PATENT DOCUMENTS

| | | | | |
|---|---|---|---|---|
| 2004/0013555 | A1* | 1/2004 | Zhong | F04C 29/12 418/201.1 |
| 2008/0080997 | A1 | 4/2008 | Chiba et al. | |
| 2016/0265529 | A1 | 9/2016 | Branch et al. | |
| 2018/0274541 | A1* | 9/2018 | Boeckx | F04C 18/088 |
| 2019/0128264 | A1* | 5/2019 | Kameya | F04C 18/16 |

OTHER PUBLICATIONS

International Search Report (PCT/ISA/210) issued in PCT Application No. PCT/JP2020/034230 dated Nov. 2, 2020 with English translation (four (4) pages).
Japanese-language Written Opinion (PCT/ISA/237) issued in PCT Application No. PCT/JP2020/034230 dated Nov. 2, 2020 (three (3) pages).

* cited by examiner

COMPARATIVE EXAMPLE

LIQUID-FEEDING ROTARY-SCREW COMPRESSOR

TECHNICAL FIELD

The present invention relates to a liquid-feeding rotary-screw compressor in which a liquid such as an oil or water is supplied into working chambers, particularly to a liquid-feeding rotary-screw compressor that delivers a compressed gas containing the liquid within the working chambers through a delivery port.

BACKGROUND ART

A rotary-screw compressor is widely spread as an air compressor and a compressor for refrigeration and air conditioning, and in recent years is strongly required to save energy. Therefore, it is more and more important for rotary-screw compressors to achieve a high energy efficiency.

A rotary-screw compressor includes a pair of male and female screw rotors with a plurality of helical lobes (grooves), and a casing that accommodates both the screw rotors in a mutually meshed state. The volumes of the working chambers formed by both the screw rotors and the inner wall of the casing are increased and decreased with rotation of both screw rotors, whereby a gas is taken in and compressed. The rotary-screw compressors include those of the liquid-feeding type in which a liquid such as an oil and water is supplied into the working chambers. The purpose of supplying the liquid into the working chambers is to cool the gas within the working chambers, to seal off a clearance between the screw rotors and the casing, and to lubricate both the screw rotors, thereby achieving enhancement of energy efficiency.

In the liquid-feeding rotary-screw compressor, it is known that power loss is caused by the liquid being trapped between both the screw rotors in a delivery process in which the compressed gas is delivered from a working chamber. Specifically, a crescent-shaped working chamber that opens in only the axial direction at the delivery ends and that is reduced in volume with rotation of the screw rotors is periodically formed by the meshing of both the screw rotors. The working chamber is in the state of partly opening relative to the delivery port formed at the inner wall surface of the casing opposed to the delivery ends of both the screw rotors, and the region opening to the delivery port becomes narrowed with the rotation of both the screw rotors. In the working chamber, since the volume is gradually reduced and the opening region relative to the delivery port is also narrowed with rotation of both the screw rotors, a state in which the liquid remaining within the working chamber is nipped by both the screw rotors is generated. As a result, the pressure in the working chamber is raised, and a torque for driving the screw rotors is increased. In other words, the pressure rise in the working chamber by the liquid being trapped between both screw rotors leads to power loss of the rotary-screw compressor.

As a countermeasure against this problem, for example, there is proposed a rotary-screw compressor described in Patent Document 1. The rotary-screw compressor is configured such that a pair of male and female rotors are rotatably accommodated under a meshed state within a casing including a suction port and a delivery port to compress gas in the state of mixing a liquid through pouring of the liquid to the gas confined within working chambers formed with both rotors and the casing. In the rotary-screw compressor, a recessed part is provided on a wall surface of the casing opposed to the rotor delivery ends and the working chamber is made to communicate with the recessed part immediately before being isolated from the delivery port, and this communication is maintained until the volume of the working chamber becomes substantially 0.

PRIOR ART DOCUMENT

Patent Document

Patent Document 1: JP-2008-82273-A

SUMMARY OF THE INVENTION

Problem to be Solved by the Invention

However, it is considered that the rotary-screw compressor described in Patent Document 1 cannot sufficiently obtain an effect of reducing power loss due to trapping of the liquid by both the screw rotors. The inventors of the present application has found out the following. It has been found out that in the aforementioned working chamber that opens in only the axial direction by meshing of both the screw rotors and is reduced in volume with the rotation of both the screw rotors, pressure rise is already started before immediately before the working chamber being isolated from the delivery port. From this point of view, in the rotary-screw compressor described in Patent Document 1, the working chamber opening in the axial direction in the delivery process comes to communicate with the recessed part immediately before being isolated from the delivery port, and therefore, it is considered that pressure rise already starts when the working chamber communicates with the recessed part. Therefore, in the rotary-screw compressor described in Patent Document 1, a pressure rise restraining effect by the recessed part is limitative.

In addition, Patent Document 1 discloses a rotary-screw compressor configured such that when the working chamber communicates with the recessed part, the recessed part communicates also with the suction side. In the case of this configuration, since the high pressure gas on the delivery-side leaks to the suction side of low pressure through the recessed part, energy efficiency is lowered by the amount of the leakage.

In the rotary-screw compressor, by meshing at the three contact points on the delivery ends of the screw rotors, a crescent-shaped working chamber that opens only in the axial direction at the delivery ends and that is expanded in volume with rotation of the screw rotors is periodically formed adjacent to and simultaneously with the aforementioned working chamber. The crescent-shaped working chamber expanded in volume communicates with the suction side of low pressure. To achieve a high energy efficiency, communication of the working chamber, which communicates with the suction side, with the delivery-side (delivery port) must be restrained as much as possible.

The present invention has been made to solve the above mentioned problem. It is an object of the present invention to provide a liquid-feeding rotary-screw compressor capable of achieving both a reduction in power loss due to trapping of the liquid by male and female rotors in the delivery process and restraint of communication between the delivery-side and the suction side.

Means for Solving the Problem

The present application includes a plurality of means for solving the above problem. One example thereof is a liquid-feeding rotary-screw compressor including: a male rotor having a delivery end on one side in an axial direction; a female rotor having a delivery end on the one side in the axial direction; and a casing having an accommodating chamber that rotatably accommodates the male rotor and the female rotor in a mutually meshed state, and a delivery port that opens in the axial direction and is formed at a delivery inner wall surface of the accommodating chamber, the delivery inner wall surface being opposed to the delivery end of the male rotor and the delivery end of the female rotor. The delivery port includes: a first opening having a profile configured to interrupt communication with a second working chamber that is increased in volume with rotation of the male rotor and the female rotor, of a first working chamber and the second working chamber that open only in the axial direction and are formed by meshing of the male rotor and the female rotor at the delivery end; a second opening connected to the first opening; and a third opening connected to the first opening and the second opening. The profile of the first opening includes: when a point obtained by projecting an intersection of a reference line passing through an axis of the male rotor and an axis of the female rotor, an tip circle of the male rotor, and a root circle of the female rotor onto the delivery inner wall surface is made to be a reference point, a first profile line that constitutes one of a pair of lateral edges of a lingulate protrusion configured to close off the second working chamber and extends toward the reference point; a second profile line that constitutes another one of the pair of lateral edges of the protrusion; a first connection line that constitutes a tip edge of the protrusion and connects the first profile line and the second profile line to each other; a third profile line that extends toward the reference point along a part of a curve obtained by projecting the root circle of the female rotor onto the delivery inner wall surface; and a second connection line that connects the first profile line and the third profile line to each other. The second opening includes a first groove that is formed on the delivery inner wall surface so as to open into the first opening at a position of the second connection line and to extend from the position of the second connection line toward the reference line in such a range as not to exceed the reference line. The third opening includes a second groove that is formed on the delivery inner wall surface so as to have a one-side end portion opening into the first groove, to open into the first opening at a position of the first profile line, and to extend along the first profile line.

Advantages of the Invention

According to the present invention, the delivery port includes the second groove that opens into the first working chamber decreasing in volume from the initial stage of formation of the first working chamber, and this allows a further discharge of the liquid from the first working chamber through the second groove at the initial stage of formation of the first working chamber and pressure rise in the first working chamber can be restrained. In addition, since the second groove is configured so as to extend along the first profile line of the first opening having a profile configured to interrupt communication with the second working chamber communicating with the suction space, the opening area of the second working chamber into the second groove can be suppressed to be small. Therefore, the configuration can achieve both a reduction in power loss arising from the trapping of the liquid by the male and female rotors in the delivery process and restraint of communication between the delivery space and the suction space.

The other problems, configurations and effects than the aforementioned will be made clear by the following description of the embodiments.

MODES FOR CARRYING OUT THE INVENTION

An embodiment of a liquid-feeding rotary-screw compressor according to the present invention will be exemplified and described below using the drawings.

FIRST EMBODIMENT

Figure 1:
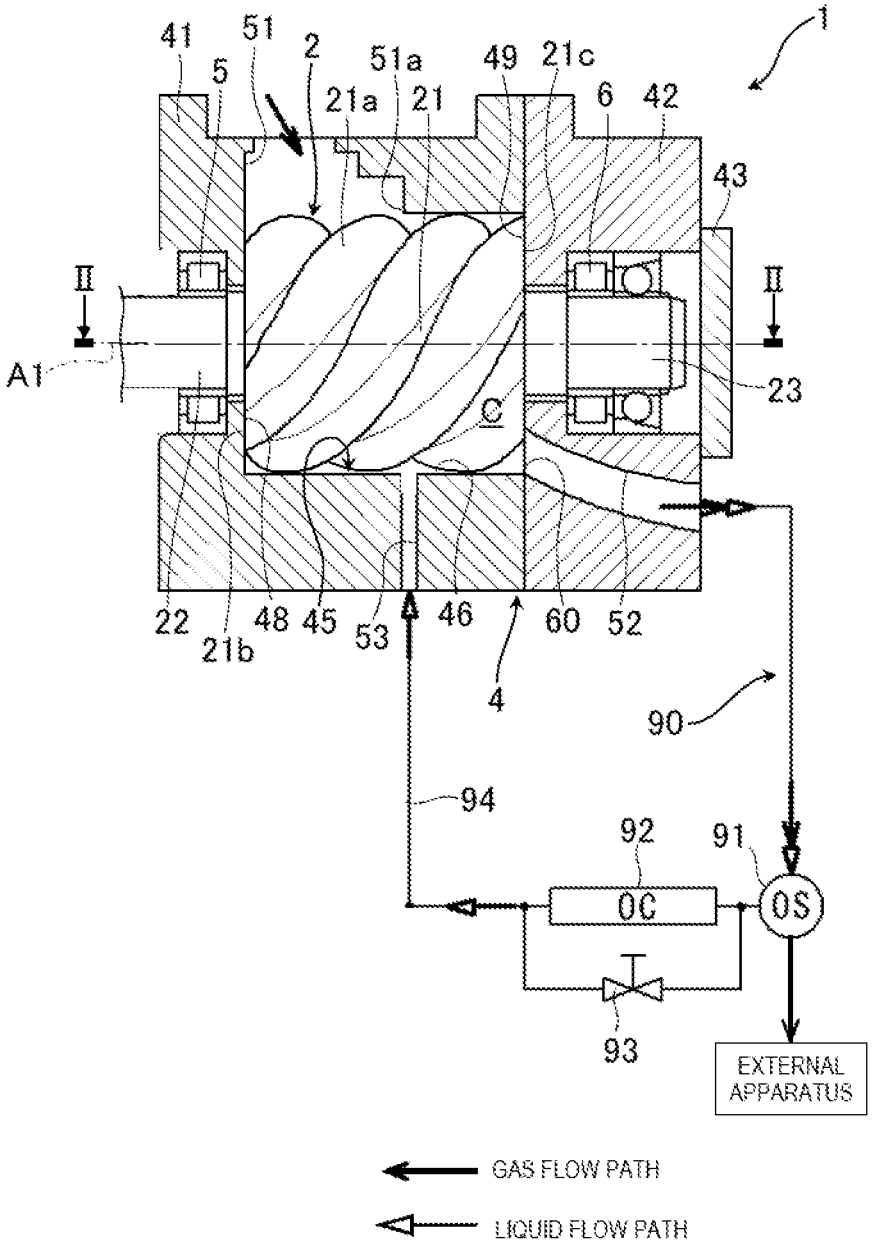
FIG. 1 is a sectional view depicting a liquid-feeding rotary-screw compressor according to a first embodiment of the present invention and a system diagram depicting an external path of feeding a liquid to the liquid-feeding rotary-screw compressor.
Figure 2:
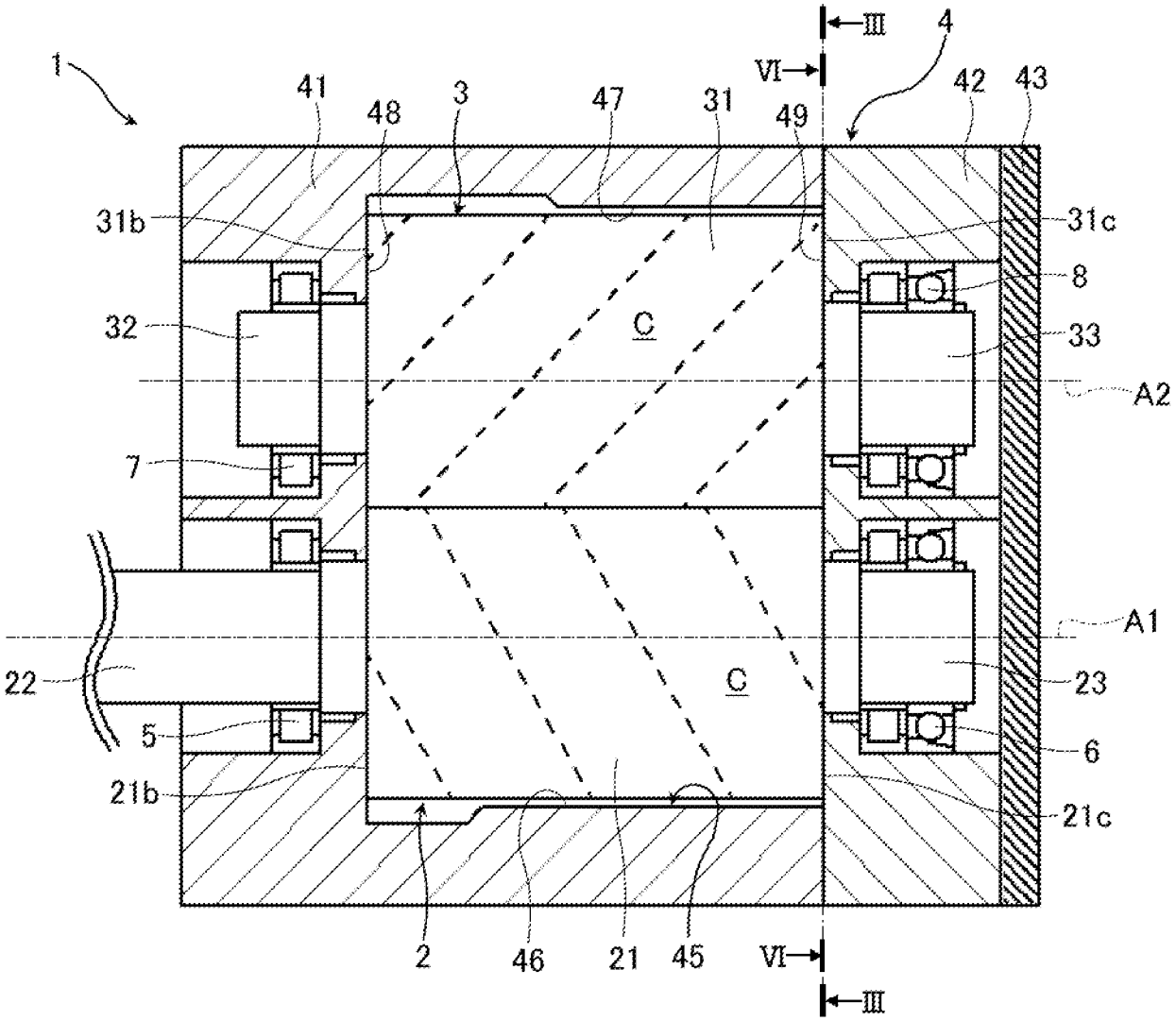
FIG. 2 is a sectional view taken along arrow II-II depicted in FIG. 1 of the liquid-feeding rotary-screw compressor according to the first embodiment of the present invention.

The configuration and operation of the liquid-feeding rotary-screw compressor according to a first embodiment will be described using FIGS. 1 and 2. FIG. 1 is a sectional view depicting the liquid-feeding rotary-screw compressor according to the first embodiment of the present invention and a system diagram depicting an external path for feeding a liquid to the liquid-feeding rotary-screw compressor. FIG. 2 is a sectional view of the liquid-feeding rotary-screw compressor according to the first embodiment of the present invention taken along arrows II-II depicted in FIG. 1. In FIGS. 1 and 2, the left side is a suction side of the liquid-feeding rotary-screw compressor, and the right side is a delivery-side. In FIG. 2, the broken line depicts an lobe tip line appearing on the bottom side (the lower side in FIG. 1) of a male rotor and a female rotor.

In FIG. 1, the liquid-feeding rotary-screw compressor (hereinafter referred to as rotary-screw compressor) 1 is supplied with a liquid such as an oil or water from the exterior to the inside. The rotary-screw compressor 1 is connected with an external liquid feeding system 90 for supplying the liquid. The external liquid feeding system 90 includes, for example, a gas-liquid separator 91, a liquid cooler 92, a adjusting valve 93, and a piping 94 connecting them with each other.

In FIGS. 1 and 2, the rotary-screw compressor 1 includes a male rotor 2 and a female rotor 3 as a pair of screw rotors mutually meshed and rotated, and a casing 4 that accommodates the male rotor 2 and the female rotor 3 rotatably in a mutually meshed state. The male rotor 2 and the female rotor 3 are disposed such that their axes A1 and A2 are parallel to each other. The male rotor 2 is rotatably supported on both sides thereof in the axial direction (the left-right direction in FIGS. 1 and 2) by a suction-side bearing section 5 and a delivery-side bearing section 6. The female rotor 3 is rotatably supported on both sides thereof in the axial direction by a suction-side bearing section 7 and a delivery-side bearing section 8.

The male rotor 2 includes a rotor lobe section 21 formed with a plurality of helical male lobes 21*a*, and a suction-side shaft section 22 and a delivery-side shaft section 23 provided respectively at both side ends in the axial direction of the rotor lobe section 21. The rotor lobe section 21 has a suction end 21*b* and a delivery end 21*c* orthogonal to the axial direction (axis A1) respectively at an one side end (left end, in FIGS. 1 and 2) and at the other side end (right end, in FIGS. 1 and 2) in the axial direction. The suction-side shaft section 22 is, for example, configured so as to extend to outside of the casing 4, and is connected to a rotational drive source not illustrated. As a rotational drive source of the rotary-screw compressor 1, for example, an electric motor is used.

The female rotor 3 includes a rotor lobe section 31 formed with a plurality of helical female lobe 31*a* (see FIG. 3 described later), and a suction-side shaft section 32 and a delivery-side shaft section 33 provided respectively at both side ends of the rotor lobe section 31. The rotor lobe section 31 has a suction end 31*b* and a delivery end 31*c* orthogonal to the axial direction (axis A2) respectively at one side end (left end, in FIG. 2) and the other side end (right end, in FIG. 2) in the axial direction. Grooves are formed between the plurality of female lobes 31*a* of the rotor lobe section 31.

The casing 4 includes a main casing 41, and a delivery-side casing 42 attached to the delivery-side (right side, in FIGS. 1 and 2) of the main casing 41.

Inside the casing 4, an accommodating chamber (bore) 45 that accommodates the rotor lobe section 21 of the male rotor 2 and the rotor lobe section 31 of the female rotor 3 in a mutually meshed state is formed. The accommodating chamber 45 is configured by closing, by the delivery-side casing 42, the opening on one side in the axial direction (right side, in FIGS. 1 and 2) of two cylindrical spaces formed in the main casing 41 and partly overlapping. A wall surface forming the accommodating chamber 45 includes a substantially cylindrical first inner circumferential surface 46 covering the radial outside of the rotor lobe section 21 of the male rotor 2, a substantially cylindrical second inner circumferential surface 47 covering the radial outside of the rotor lobe section 31 of the female rotor 3, a suction inner wall surface 48 on one side in the axial direction (left side, in FIGS. 1 and 2) opposed to the suction ends 21*b* and 31*b* of the rotor lobe sections 21 and 31 of the male and female rotors 2 and 3, and a delivery inner wall surface 49 on the other side in the axial direction (right side, in FIGS. 1 and 2) opposed to the delivery ends 21*c* and 31*c* of the rotor lobe sections 21 and 31 of the male and female rotors 2 and 3. The rotor lobe sections 21 and 31 of the male and female rotors 2 and 3 and inner wall surfaces (the first inner circumferential surface 46, the second inner circumferential surface 47, the suction inner wall surface 48, and the delivery inner wall surface 49 of the accommodating chamber 45) surrounding them form a plurality of working chambers C.

In a suction-side end portion of the main casing 41, the suction-side bearing section 5 on the male rotor 2 side and the suction-side bearing section 7 on the female rotor 3 side are disposed. In the delivery-side casing 42, the delivery-side bearing section 6 on the male rotor 2 side and the delivery-side bearing section 8 on the female rotor 3 side are disposed. To the delivery-side casing 42, a delivery-side cover 43 is attached so as to cover the delivery-side bearing section 6 and the delivery-side bearing section 8.

As depicted in FIG. 1, the casing 4 is provided with an suction passage 51 for suction of a gas into the working chambers C. The suction passage 51 is for establishing communication between the exterior of the casing 4 and the accommodating chamber 45 (working chambers C). The suction passage 51, for example, has an suction port 51*a* opening in an inner wall surface of the casing 4.

In addition, the casing 4 is provided with a delivery passage 52 for delivering a compressed gas from the working chambers C to the exterior of the casing 4. The delivery passage 52 is for establishing communication between the accommodating chamber 45 (working chambers C) and the exterior of the casing 4, and is connected to the external liquid feeding system 90. The delivery passage 52 has an axial delivery port 60 formed at the delivery inner wall surface 49 of the casing 4 and opens in the axial direction. Details of the structure of the axial delivery port 60 will be described later.

The casing 4 is provided with a liquid feeding passage 53 for supplying the liquid supplied from the exterior (external liquid feeding system 90) of the rotary-screw compressor 1 into the working chambers C. The liquid feeding passage 53, for example, opens to a region of the inner wall surface of the accommodating chamber 45 where the working chambers C become a compression process.

In the rotary-screw compressor 1 of the present embodiment having the aforementioned configuration, the male rotor 2 depicted in FIG. 2 is driven by a rotational drive source not illustrated, whereby the female rotor 3 is rotationally driven. As a result, the working chambers C (the lobes 21*a* and 31*a* of the male and female rotors 2 and 3) advances toward the delivery-side (right side, in FIG. 2) in the axial direction with the rotation of the male and female rotors 2 and 3. In this instance, the working chambers C increase the volume thereof to take in the gas from the exterior through the suction passage 51 depicted in FIG. 1, and reduces the volume thereof to compress the gas to a predetermined pressure. The compressed gas in the working chambers C is finally delivered to the gas-liquid separator 91 of the external liquid feeding system 90 through the delivery passage 52.

The rotary-screw compressor 1 is supplied with the liquid in the inside, so that a liquid is mixed in the delivered compressed gas. This liquid contained in the compressed gas is separated from the compressed gas by the gas-liquid separator 91. The compressed gas from which the liquid has been removed in the gas-liquid separator 91 is supplied to an external apparatus as required.

On the other hand, the liquid separated from the compressed gas in the gas-liquid separator 91 is cooled by the liquid cooler 92 of the external liquid feeding system 90, and is then charged into the working chambers C through a liquid feeding system (liquid feeding passage 53) of the rotary-screw compressor 1. The flow amount of the liquid cooler 92 is adjusted by the adjusting valve 93. The supply of the liquid to the rotary-screw compressor 1 can be conducted not by use of a power source such as a pump, but by use of the pressure of the compressed gas flowing into the gas-liquid separator 91 as a power source.

Figure 3:
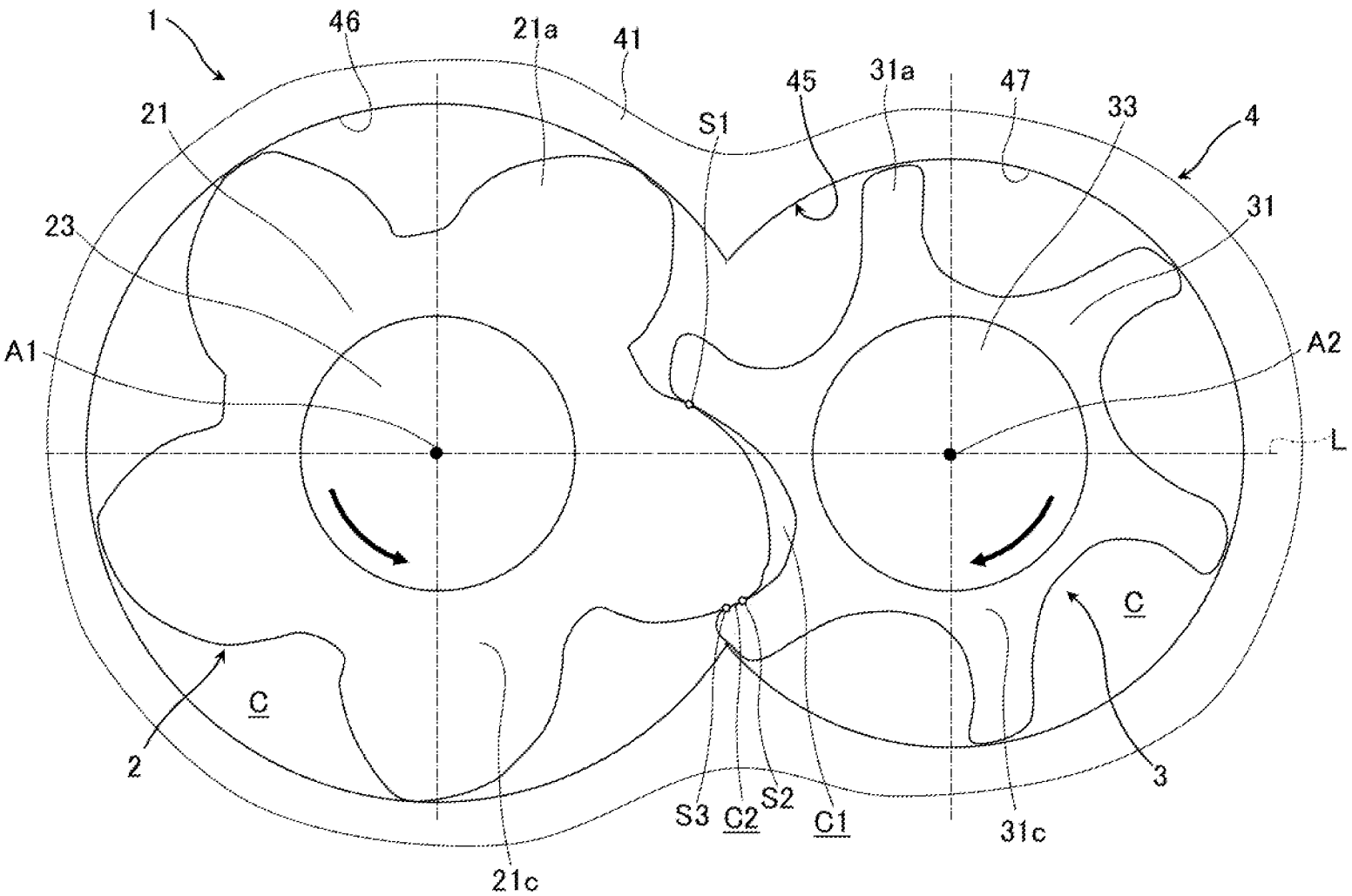
FIG. 3 is a diagram taken along arrow III-III depicted in FIG. 2 of the liquid-feeding rotary-screw compressor according to the first embodiment of the present invention, and is a diagram depicting a first working chamber and a second working chamber which are formed by meshing of male and female rotors and open only in the axial direction at a delivery end.
Figure 4:
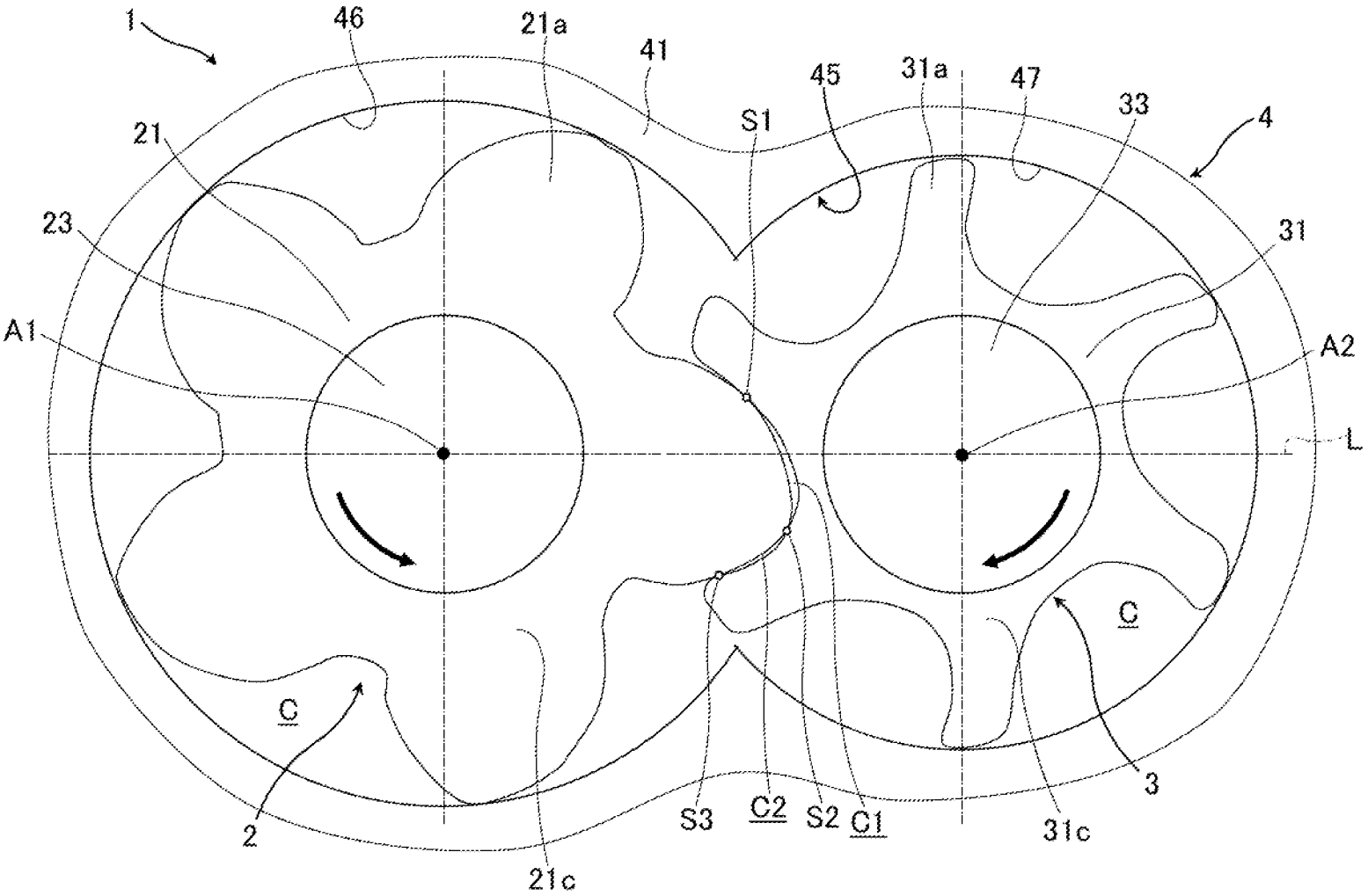
FIG. 4 is an illustration depicting the first working chamber and the second working chamber of the liquid-feeding rotary-screw compressor according to the first embodiment of the present invention in a state progressed from a rotational position of both rotors depicted in FIG. 3.
Figure 5:
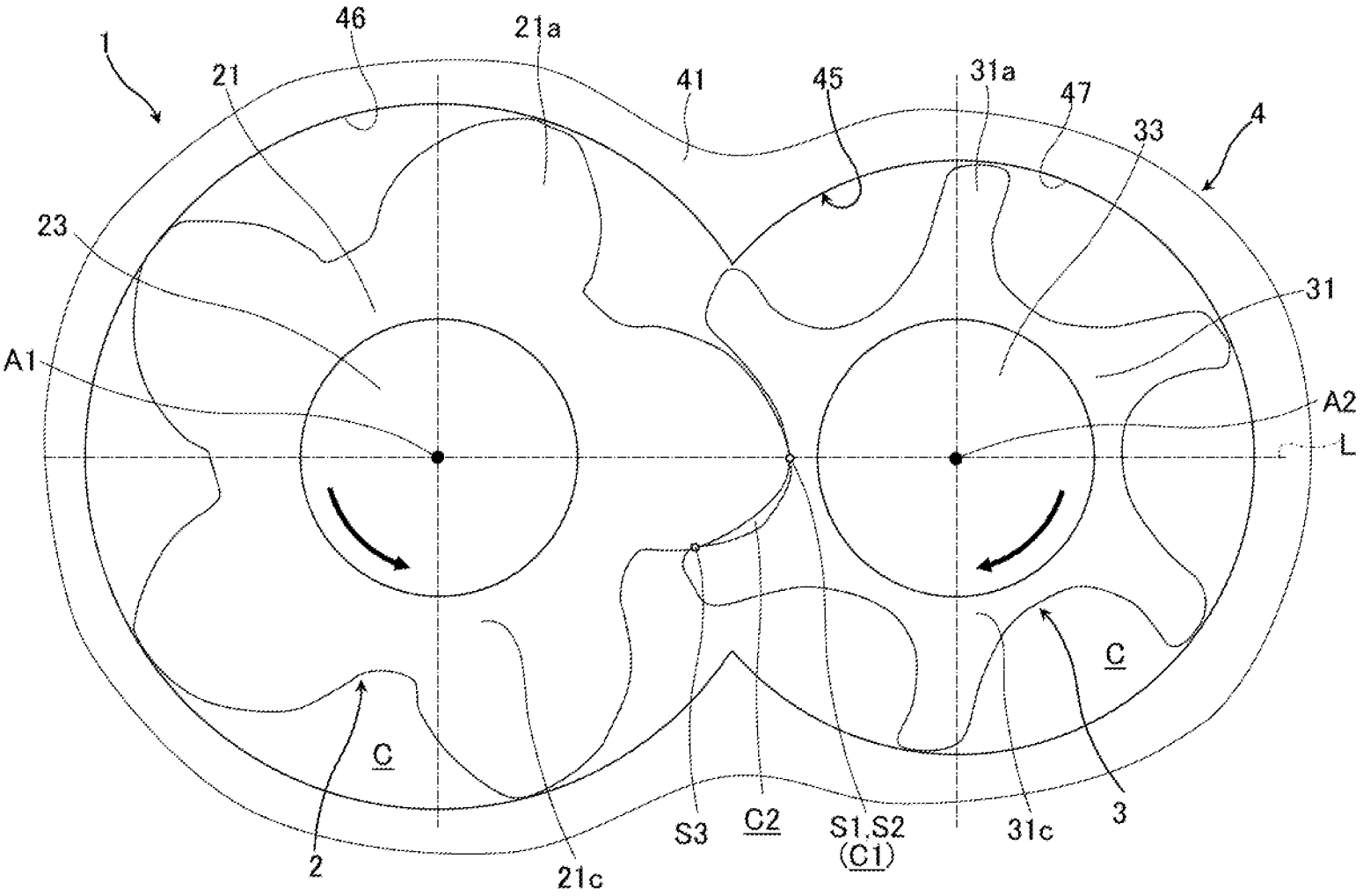
FIG. 5 is an illustration depicting the first working chamber and the second working chamber of the liquid-feeding rotary-screw compressor according to the first embodiment of the present invention in a state progressed from a rotational position of both rotors depicted in FIG. 4.

Next, the working chambers formed by meshing of the male and female rotors in the liquid-feeding rotary-screw compressor of the first embodiment will be described using FIGS. 3 to 5. FIG. 3 is a view, taken along arrows III-III depicted in FIG. 2, of the liquid-feeding rotary-screw compressor according to the first embodiment of the present invention, and is a diagram depicting the first working chamber and the second working chamber which are formed by meshing of the male and female rotors and open only in the axial direction at the delivery end. FIG. 4 is an illustration depicting the first working chamber and the second working chamber in the liquid-feeding rotary-screw compressor according to the first embodiment of the present invention in a state progressed from a rotational position of both rotors depicted in FIG. 3. FIG. 5 is an illustration depicting the first working chamber and the second working chamber in the liquid-feeding rotary-screw compressor according to the first embodiment of the present invention in a state progressed from a rotational position of both rotors depicted in FIG. 4. In FIGS. 3 to 5, the thick arrow indicates the rotating direction of the male and female rotors.

In the present invention, with a lobe tip of the male rotor 2 as a boundary, a flank on a rotating direction side is defined as a leading flank of the male rotor 2, and a flank on the side opposite to the rotating direction is defined as a trailing flank of the male rotor 2. In addition, with a root of the female rotor 3 as a boundary, a flank on a rotating direction side is defined as an leading flank of the female rotor 3, and a flank on the side opposite to the rotating direction is defined as a trailing flank of the female rotor 3.

As depicted in FIGS. 3 to 5, when the delivery ends 21*c* and 31*c* of the male rotor 2 and the female rotor 3 are meshed together, a first working chamber C1 and a second working chamber C2 that are two crescent-shaped working chambers not opening in the radial direction of the male and female rotors 2 and 3 but opening only in the axial direction are periodically formed at the delivery ends 21*c* and 31*c*. The first working chamber C1 is formed between a theoretical first contact point S1 where the leading flank of the male rotor 2 and the leading flank of the female rotor 3 make contact with each other and a theoretical second contact point where the trailing flank of the male rotor 2 and the trailing flank of the female rotor 3 make contact with each other. The first working chamber C1 is reduced in volume as the male and female rotors 2 and 3 rotate, and does not communicate with the suction passage 51 (see FIG. 1). The second working chamber C2 is formed between the aforementioned second contact point S2 and a theoretical third contact point S3 where, rather than the second contact point S2, a part on the root side of the trailing flank of the male rotor 2 and a part on the tip side of the trailing flank of the female rotor 3 make contact with each other. The second working chamber C2 is increased in volume as the male and female rotors 2 and 3 rotate, and communicates with the suction passage 51 (suction space).

FIG. 3 depicts a rotational position where the crescent-shaped first working chamber C1 is initially formed (generated) by meshing of the male and female rotors 2 and 3 on the delivery ends 21*c* and 31*c*. Simultaneously, this is also a rotational position where the second working chamber C2 is initially formed (generated) as a space of which the volume is substantially 0. In the present embodiment, at the rotational position where the second working chamber C2 starts to be formed, the male and female rotors 2 and 3 are configured such that the flanks of the male and female rotors 2 and 3 at the delivery ends 21*c* and 31*c* make line contact with each other between the second contact point S2 and the third contact point S3 constituting both ends of the second working chamber C2.

The first working chamber C1 is gradually reduced in volume as the rotational positions of the male and female rotors 2 and 3 advance from the positions depicted in FIG. 3 toward the positions depicted in FIG. 4. On the other hand, the second working chamber C2 is gradually increased in volume from the state of 0 (the state of line contact) as the rotational positions of the male and female rotors 2 and 3 advance from the positions depicted in FIG. 3 toward the positions depicted in FIG. 4. The first contact point S1 which is one of boundaries of the first working chamber C1 moves toward the tip side of the leading flank of the male rotor 2 and the root side of the leading flank of the female rotor 3, as the male and female rotors 2 and 3 rotate. The second contact point S2 which is a boundary between the first working chamber C1 and the second working chamber C2 is moved toward the tip side of the trailing flank of the male rotor 2 and the root side of the trailing flank of the female rotor 3, as the male and female rotors 2 and 3 rotate. The third contact point S3 which is the other boundary of the second working chamber C2 is moved toward the root side of the trailing flank of the male rotor 2, as the male and female rotors 2 and 3 rotate. In other words, the first contact point S1 and the second contact point S2 approach each other, whereas the second contact point S2 and the third contact point S3 are spaced far from each other.

FIG. 5 depicts a rotational position where the first contact point S1 and the second contact point S2 coincide with each other and the volume of the first working chamber C1 becomes 0. Simultaneously, this is a rotational position where the volume of the second working chamber C2 becomes maximum. This is a position where the lobe tip of the male rotor 2 and the root of the female rotor 3 make contact with each other, and the first working chamber C1 disappears. When the male and female rotors 2 and 3 are rotated more than this, the working chambers opening only in the axial direction at the delivery ends 21*c* and 31*c* of the male and female rotors 2 and 3 disappear, and only the working chambers C opening in both the radial direction and the axial direction are formed.

As depicted in FIGS. 3 to 5, by meshing of the male and female rotors 2 and 3, there is present the second working chamber C2 which is opened only in the axial direction at the delivery ends 21*c* and 31*c* of the male and female rotors 2 and 3 and is in a suction process. The second working chamber C2 is increased in volume as the male and female rotors 2 and 3 rotate, and is moved toward the side of the reference line L passing through the axis A1 of the male rotor 2 and the axis A2 of the female rotor 3. If the second working chamber C2 communicates with the delivery passage 52 (see FIG. 1), the compressed gas at high pressure in the delivery passage 52 flows out to the suction passage 51 (see FIG. 1) at the low pressure side through the second working chamber C2. Therefore, the axial delivery port 60 should be formed such that the second working chamber C2 does not communicate with the delivery passage 52.

Figure 6:
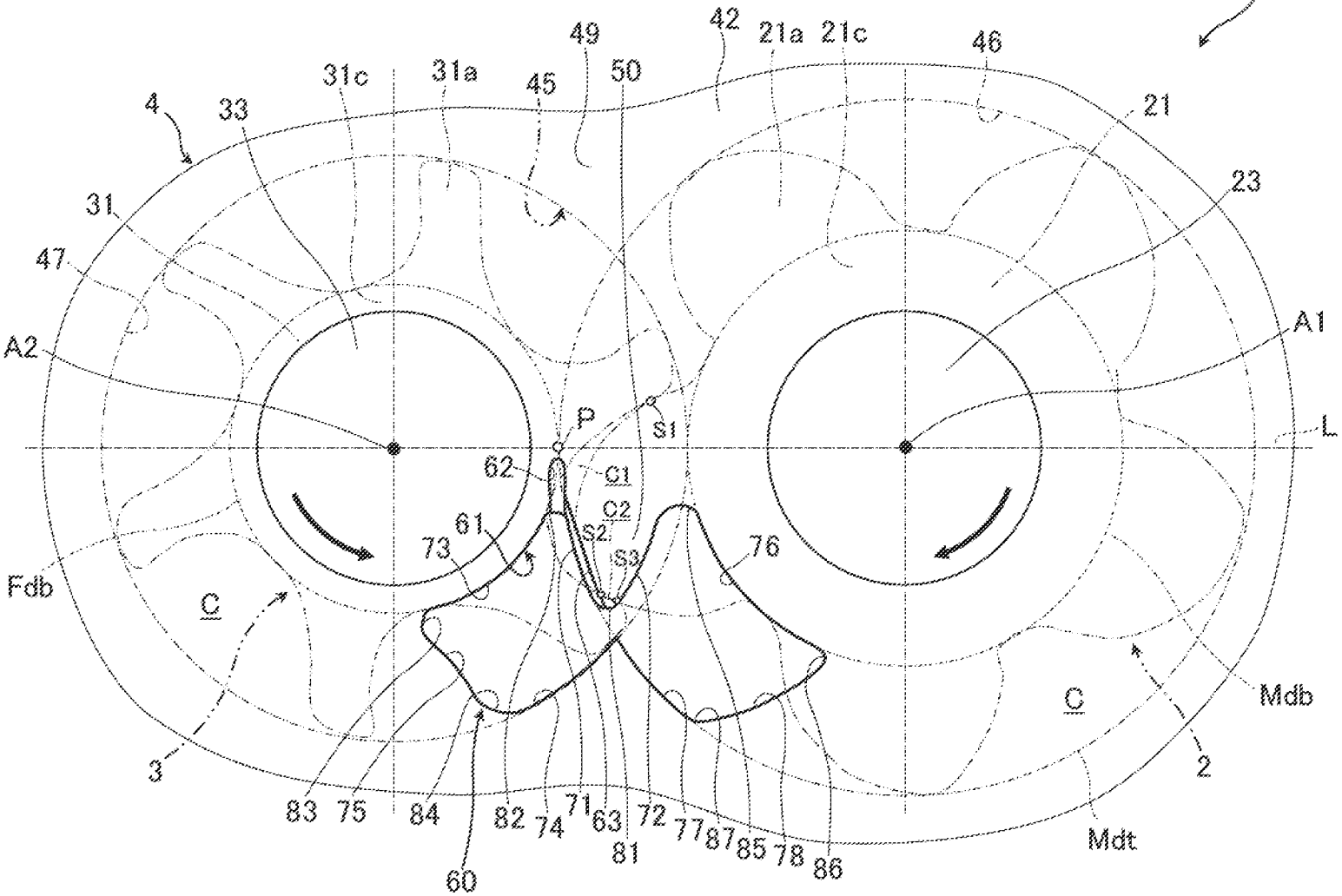
FIG. 6 is a sectional view taken along arrow VI-VI depicted in FIG. 2 of the liquid-feeding rotary-screw compressor according to the first embodiment of the present invention.

Next, the structure of the axial delivery port in the liquid-feeding rotary-screw compressor according to the first embodiment will be described. FIG. 6 is a sectional view, (partly omitted) taken along arrows VI-VI depicted in FIG. 2, of the liquid-feeding rotary-screw compressor according to the first embodiment of the present invention. In FIG. 6, the shape in which the delivery ends of the male and female rotors are projected onto the delivery inner wall surface of the casing is indicated by alternate long and two short dashes line. In addition, the thick arrows indicate rotating directions of both rotors.

In FIG. 6, the axial delivery port 60 is formed in a region on one side (the lower side, in FIG. 6) relative to the reference line L passing through the axis A1 of the male rotor 2 and the axis A2 of the female rotor 3. The axial delivery port 69 includes a first opening 61 of a closed curve that includes a profile capable of interrupting communication with the aforementioned second working chamber C2 formed by meshing of the male and female rotors 2 and 3 at the delivery ends 21*c* and 31*c*, a first groove 62 formed on the delivery inner wall surface 49 of the casing 4 as a second opening connected to the first opening 61, and the second groove 63 formed on the delivery inner wall surface 49 of the casing 4 as a third opening connected to the first opening 61 and the second opening (the first groove 62). The first opening 61 and the first groove 62 as the second opening are similar to the structure adopted as the axial delivery port according to the prior art. The second groove 63 as the third opening is a characteristic part of the present embodiment, and the details of the structure thereof will be described later.

when a point obtained by projecting the intersection of the reference line L, the tip circle Mdt of the male rotor 2, and the root circle Fdb of the female rotor 3 onto the delivery inner wall surface 49 of the casing 4 is made to be the reference point P, the profile of the first opening 61 of the axial delivery port 60 includes a first profile line 71 which constitutes one of a pair of lateral edges of a lingulate protrusion 50 capable of closing off the aforementioned moving second working chamber C2 (see FIGS. 3 to 5 and FIG. 13 described later) and which extends toward the reference point P, a second profile line 72 that constitutes the other of the pair of lateral edges of the protrusion 50, and a first connection line 81 which constitutes a tip edge of the protrusion 50 and which connects the first profile line 71 and the second profile line 72 with each other. The first profile line 71 is, for example, configured so as to extend toward the reference point P along a part of a curve obtained by projecting the tip circle Mdt of the male rotor 2 onto the delivery inner wall surface 49 of the casing 4. The first profile line 71 is located on the outer side of the second working chamber C2 relative to a curve obtained by projecting a locus of the contact point S2 (see FIGS. 3 to 5 and FIG. 13 described later), which is a boundary between the first working chamber C1 and the second working chamber C2, of the theoretical three contact points S1, S2, and S3 generated by meshing of the male and female rotors 2 and 3 on the delivery ends 21*c* and 31*c*, onto the delivery inner wall surface 49 of the casing 4. The second profile line 72 is, for example, configured so as to extend along a curve obtained by projecting the locus of the contact point S3 (see FIGS. 3 to 5 and FIG. 13 described later), which is a boundary on the other side of the second working chamber C2, onto the delivery inner wall surface 49 of the casing 4. The first connection line 81 is, for example, configured by an arc or curve which smoothly connects the first profile line 71 and the second profile line 72 with each other.

Note that the lingulate protrusion 50 is located in a region on one side (the lower side, in FIG. 6) relative to the reference line L of the casing 4 (the delivery-side casing 42), and has such a shape as to protrude to inside of the axial delivery port 60 toward a direction of spacing away from the reference line L.

In addition, the profile of the first opening 61 includes, for example, the third profile line 73 which extends toward the reference point P along a part of a curve obtained by projecting the root circle Fdb of the female rotor 3 onto the delivery inner wall surface 49 of the casing 4, a fourth profile line 74 which extends along a part of a curve obtained by projecting the second inner circumferential surface 47 on the female rotor 3 side of the accommodating chamber 45 onto the delivery inner wall surface 49 of the casing 4 and is opposed to the third profile line 73, and the fifth profile line 75 which extends along a curve obtained by projecting the shape of the leading flank of the delivery end 31*c* of the female rotor 3 onto the delivery inner wall surface 49 of the casing 4. The third profile line 73 has an end on the reference point P side thereof smoothly connected to an end on the reference point P side of the first profile line 71 by a second connection line 82. The third profile line 73 and the fifth profile line 75 are smoothly connected to each other by a third connection line 83. The fourth profile line 74 and the fifth profile line 75 are smoothly connected to each other by a fourth connection line 84. The second connection line 82, the third connection line 83, and the fourth connection line 84 are each, for example, an arc or a curved line in shape.

Besides, the profile of the first opening 61 includes, for example, a sixth profile line 76 which extends along a part of a curve obtained by projecting the root circle Mdb of the male rotor 2 onto the delivery inner wall surface 49 of the casing 4, a seventh profile line 77 which extends along a part of a curve obtained by projecting the first inner circumferential surface 46 on the male rotor 2 side of the accommodating chamber 45 onto the delivery inner wall surface 49 of the casing 4 and is opposed to the sixth profile line 76, and an eighth profile line 78 which extends along a curve obtained by projecting the shape of the trailing flank of the delivery end 21*c* of the male rotor 2 onto the delivery inner wall surface 49 of the casing 4. The sixth profile line 76 has an end near the reference line L smoothly connected to an end near the reference line L of the second profile line 72 by a fifth connection line 85. The sixth profile line 76 and the eighth profile line 78 are smoothly connected to each other by a sixth connection line 86. The seventh profile line 77 and the eighth profile line 78 are smoothly connected to each other by a seventh connection line 87. The fifth connection line 85, the sixth connection line 86, and the seventh connection line 87 are each, for example, an arc or a curved line in shape.

As aforementioned, the first opening 61 is formed in such a shape as to be able to interrupt communication with the second working chamber C2 in the suction process (see FIGS. 3 to 5 or FIG. 13 described later), which is formed by meshing of the male and female rotors 2 and 3 on the delivery ends 21*c* and 31*c* and opens in only the axial direction, and has a profile of a closed curve constituted of the first to eighth profile lines 71 to 78 and the first to seventh connection lines 81 to 87 connecting them with each other.

The first groove 62 as the second opening of the axial delivery port 60 is configured so as to open into the first opening 61 at the second connection line 82 and extend from the second connection line 82 toward the reference line L in such a range as not to exceed the reference line L. The first groove 62 maintains communication between the first working chamber C1 (see, for example, FIG. 10 described later) and the first opening 61 at a final stage of a delivery process at which the contact point S2 as a boundary between the first working chamber C1 and the second working chamber C2 has approached the reference point P and a reduction in volume has advanced, and secures a discharge path for the liquid remaining within the first working chamber C1.

The first working chamber C1 in the delivery process, which opens in only the axial direction by meshing of the male and female rotors 2 and 3 on the delivery ends 21*c* and 31*c*, finally disappears with its volume becoming 0 at a certain rotational position. If the axial delivery port is composed only of the first opening 61, pressure in the first working chamber C1 is raised due to the influence of the remaining liquid when the area opening into the first opening 61 is reduced as the male and female rotors 2 and 3 rotate. In other words, if the liquid remains in the first working chamber C1 of which the volume is gradually reduced, the male and female rotors 2 and 3 finally come into a state of nipping the liquid. When the pressure in the first working chamber C1 is raised, torque for driving the male and female rotors 2 and 3 increases correspondingly to the pressure rise, and power of the rotary-screw compressor 1 is lost.

In view of this, the first working chamber C1 at the final stage of the delivery process is made to communicate with the first opening 61 through the first groove 62, whereby the liquid remaining in the first working chamber C1 at the final stage of the delivery process is discharged to the first opening 61 (the delivery passage 52) through the first groove 62. As a result, a reduction in the loss of power of the rotary-screw compressor 1 due to nipping of the liquid by the male and female rotors 2 and 3 at the final stage of the delivery process is achieved.

Figure 7:
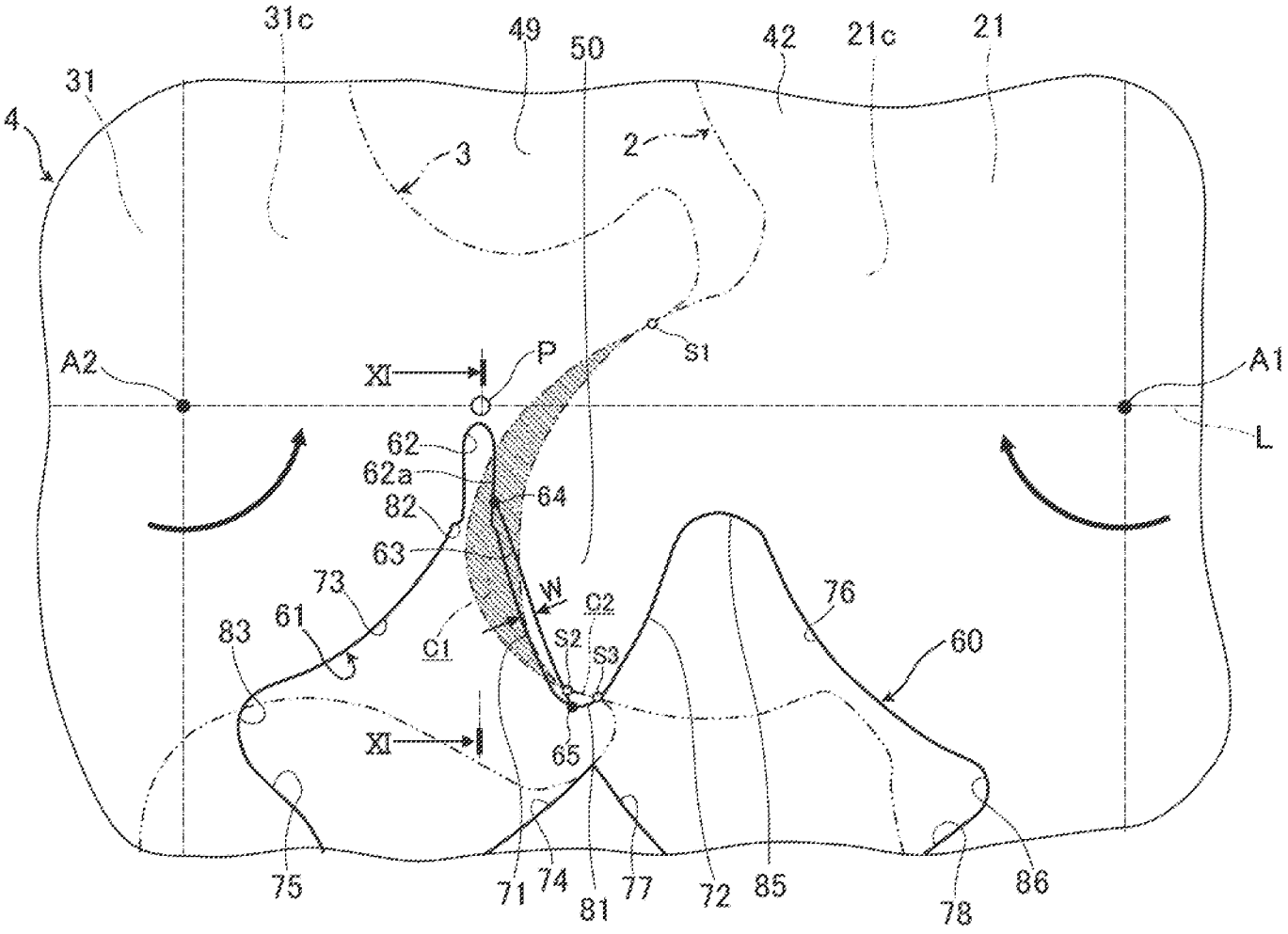
FIG. 7 is an illustration depicting the positional relation between an axial delivery port and the first and the second working chambers opening only in the axial direction in the liquid-feeding rotary-screw compressor according to the first embodiment of the present invention.
Figure 8:
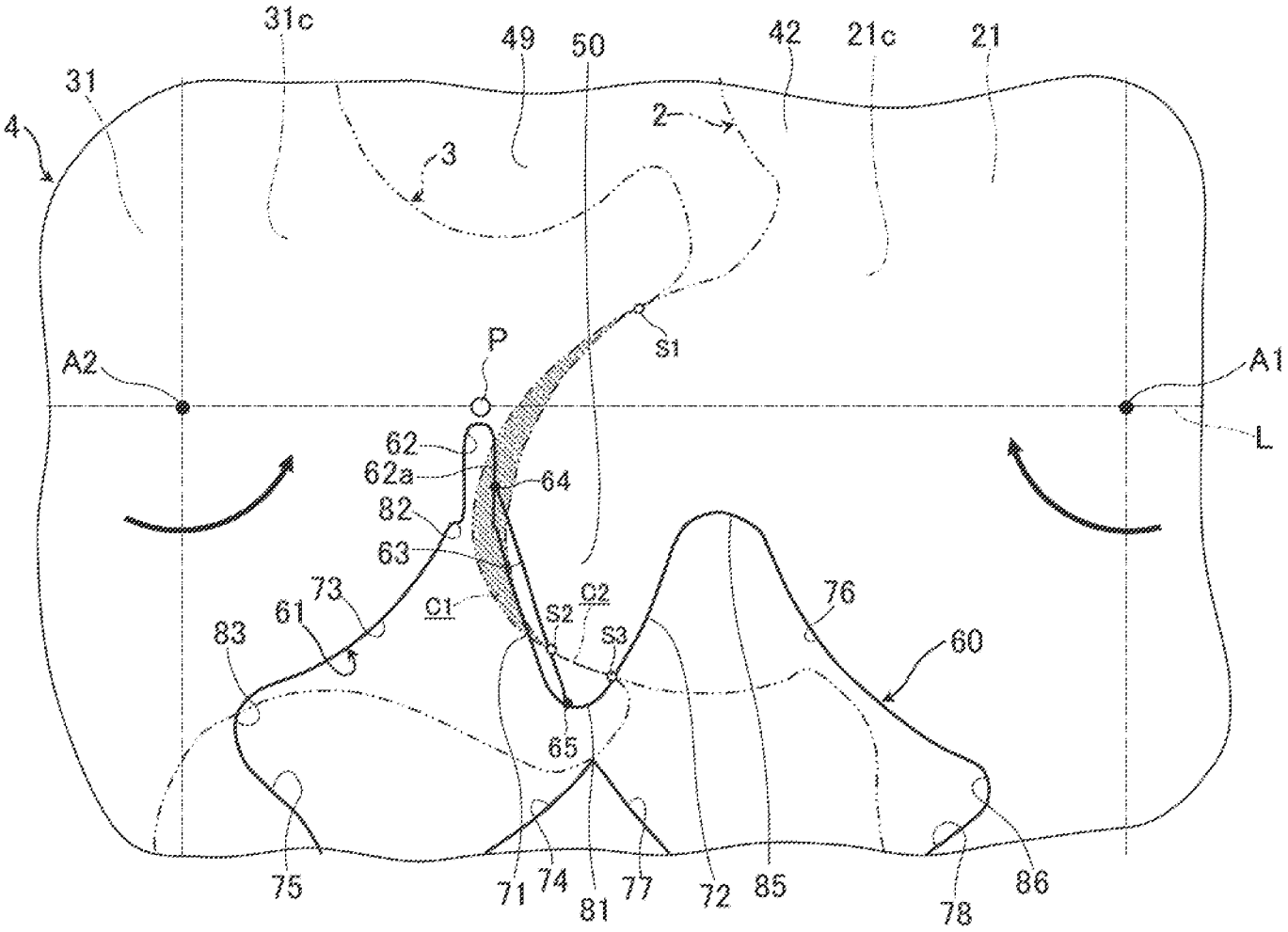
FIG. 8 is an illustration depicting the positional relation between the axial delivery port and the first and the second working chambers in the liquid-feeding rotary-screw compressor according to the first embodiment of the present invention, in a state of progressed from a rotational position of both rotors depicted in FIG. 7.
Figure 9:
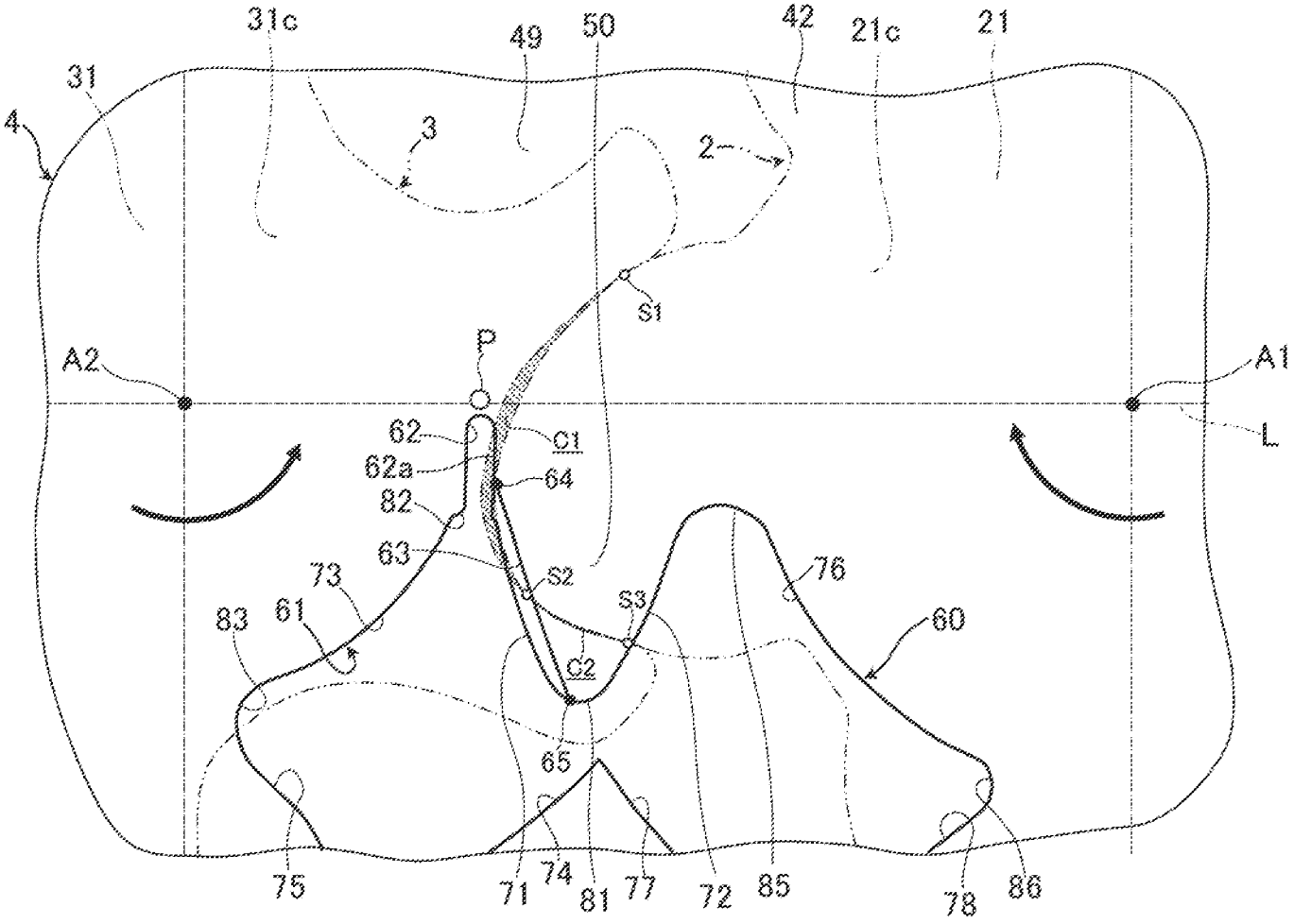
FIG. 9 is an illustration depicting the positional relation between the axial delivery port and the first and the second working chambers in the liquid-feeding rotary-screw compressor according to the first embodiment of the present invention, in a state progressed from a rotational position of both rotors depicted in FIG. 8.
Figure 10:
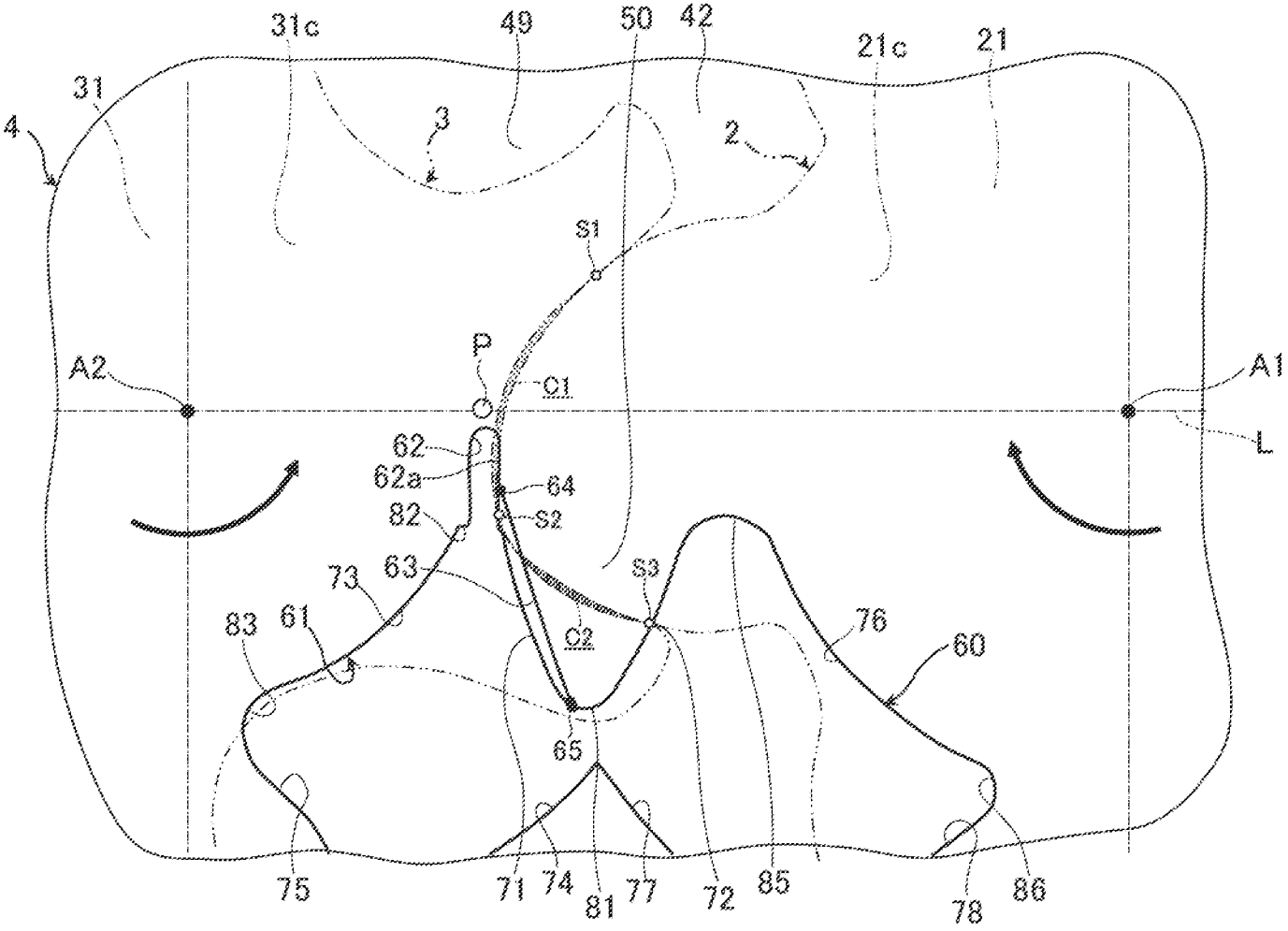
FIG. 10 is an illustration depicting the positional relation between the axial delivery port and the first and the second working chambers in the liquid-feeding rotary-screw compressor according to the first embodiment of the present invention, in a state progressed from a rotational position of both rotors depicted in FIG. 9.
Figure 11:
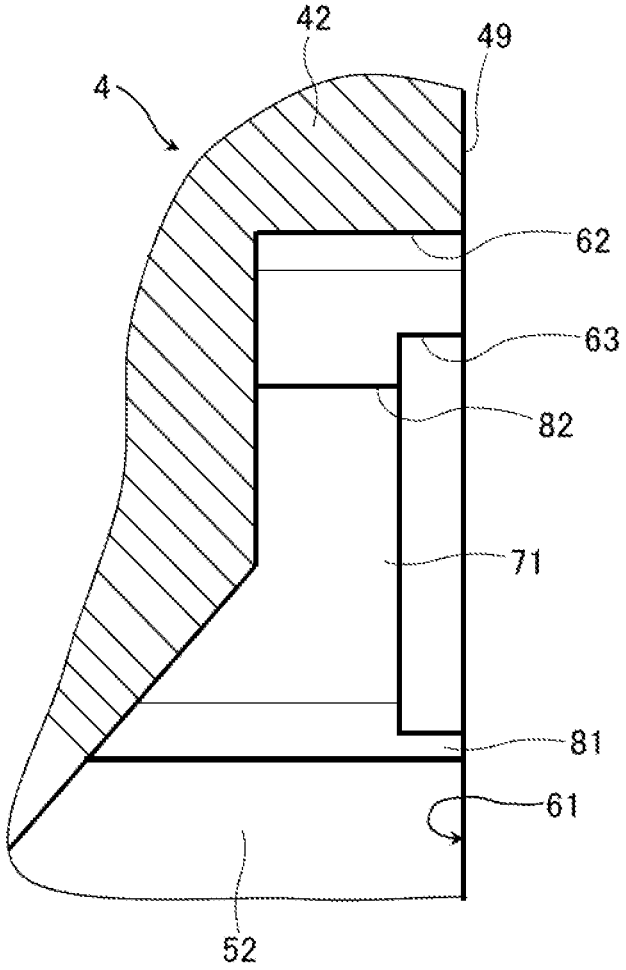
FIG. 11 is a partial sectional view, taken along arrows XI-XI depicted in FIG. 7, of the structure of a first opening, a first groove, and a second groove of the axial delivery port in the liquid-feeding rotary-screw compressor according to the first embodiment of the present invention.

Next, the structure of the second groove of the axial delivery port in the liquid-feeding rotary-screw compressor according to the present embodiment will be described using FIGS. 7 to 11. FIG. 7 is an illustration depicting a positional relation between the axial delivery port and the first and the second working chambers opening in only the axial direction in the liquid-feeding rotary-screw compressor according to the first embodiment of the present invention. FIG. 8 is an illustration depicting a positional relation between the axial delivery port and the first and the second working chambers in the liquid-feeding rotary-screw compressor according to the first embodiment of the present invention, in a state progressed from the rotational position of both rotors depicted in FIG. 7. FIG. 9 is an illustration depicting a positional relation between the axial delivery port and the first and the second working chambers in the liquid-feeding rotary-screw compressor according to the first embodiment of the present invention, in a state progressed from the rotational position of both rotors depicted in FIG. 8. FIG. 10 is an illustration depicting a positional relation between the axial delivery port and the first and the second working chambers in the liquid-feeding rotary-screw compressor according to the first embodiment of the present invention, in a state progressed from the rotational position of both rotors depicted in FIG. 9. FIG. 11 is a partial sectional view, taken along arrows XI-XI depicted in FIG. 7, of the structure of the first opening, the first groove, and the second groove of the axial delivery port in the liquid-feeding rotary-screw compressor according to the first embodiment of the present invention.

In FIGS. 7 to 10, the shape obtained by projecting the delivery ends of the male and female rotors onto the delivery inner wall surface of the casing is indicated by alternate long and two short dashes line. In addition, the thick arrows indicate rotational directions of the male and female rotors.

In FIGS. 7 to 11, the second groove 63 of the axial delivery port 60 is configured so as to have a one-side end opening into the first groove 62 and to open into the first opening 61 at the position of the first profile line 71 and to extend along the first profile line 71. As depicted in FIGS. 7 and 8, the second groove 63 increases the opening area for enabling communication between the first working chamber C1 and the first opening 61, at an initial stage at which the first working chamber C1 of the delivery process opening in only the axial direction is formed, whereby the liquid remaining within the first working chamber C1 at the initial stage at which the first working chamber C1 is formed is easily discharged. FIG. 7 depicts a rotational position where the first working chamber C1 (volume is maximum) and the second working chamber C2 (volume is 0), which do not open in the radial direction but open in only the axial direction by meshing of the male and female rotors 2 and 3 at the delivery ends, start to be formed (is just generated). FIG. 8 depicts a rotational position slightly progressed from the rotational position depicted in FIG. 7, and depicts the state of the initial stage where the first working chamber C1 and the second working chamber C2 are formed.

Of the part of the connection of the second groove 63 to the first groove 62, the position 64 nearest to the reference line L is, as depicted in FIG. 9, configured so as to be a position that the flank of the delivery end 21*c* of the male rotor 2 projected onto the delivery inner wall surface 49 of the casing 4, of side edges (side faces) 62*a* of the first groove 62, earliest reaches by rotation. FIG. 9 depicts a rotational position where the flank of the delivery end 21*c* of the male rotor 2 projected onto the delivery inner wall surface 49 of the casing 4 initially reaches the side edge (side face) 62*a* of the first groove 62 on the side near the axis A1 of the male rotor 2. Note that in FIGS. 7 and 8, the flank of the delivery end 21*c* of the male rotor 2 projected onto the delivery inner wall surface 49 of the casing 4 has not reached the first groove 62.

In addition, the second groove 63 is configured such that the other side end (the lower side end, in FIGS. 7 to 9) opens into the first opening 61 at the position 65 of the first connection line 81. In other words, the second groove 63 is configured so as to extend over the whole of the first profile line 71.

The groove width W of the second groove 63 is preferably set to be, as depicted in FIG. 7, ¼ to ½ times the groove width of the first groove 62, or to be 1/100 to 2/100 times the diameter (outside diameter) of the tip circle Mdt (see FIG. 6) of the male rotor 2. The second groove 63 extending along the first profile line 71 has the groove width W set as aforementioned, and is configured such that, depending on the rotational positions of the male and female rotors 2 and 3, as depicted in FIG. 10, communication is generated with a part of the aforementioned second working chamber C2 communicating with the suction passage 51 (see FIG. 1). FIG. 10 depicts that the first working chamber C1 is at the state of the final stage of the delivery process, whereas the second working chamber C2 has moved toward the reference line L side to expand its volume.

Figure 12:
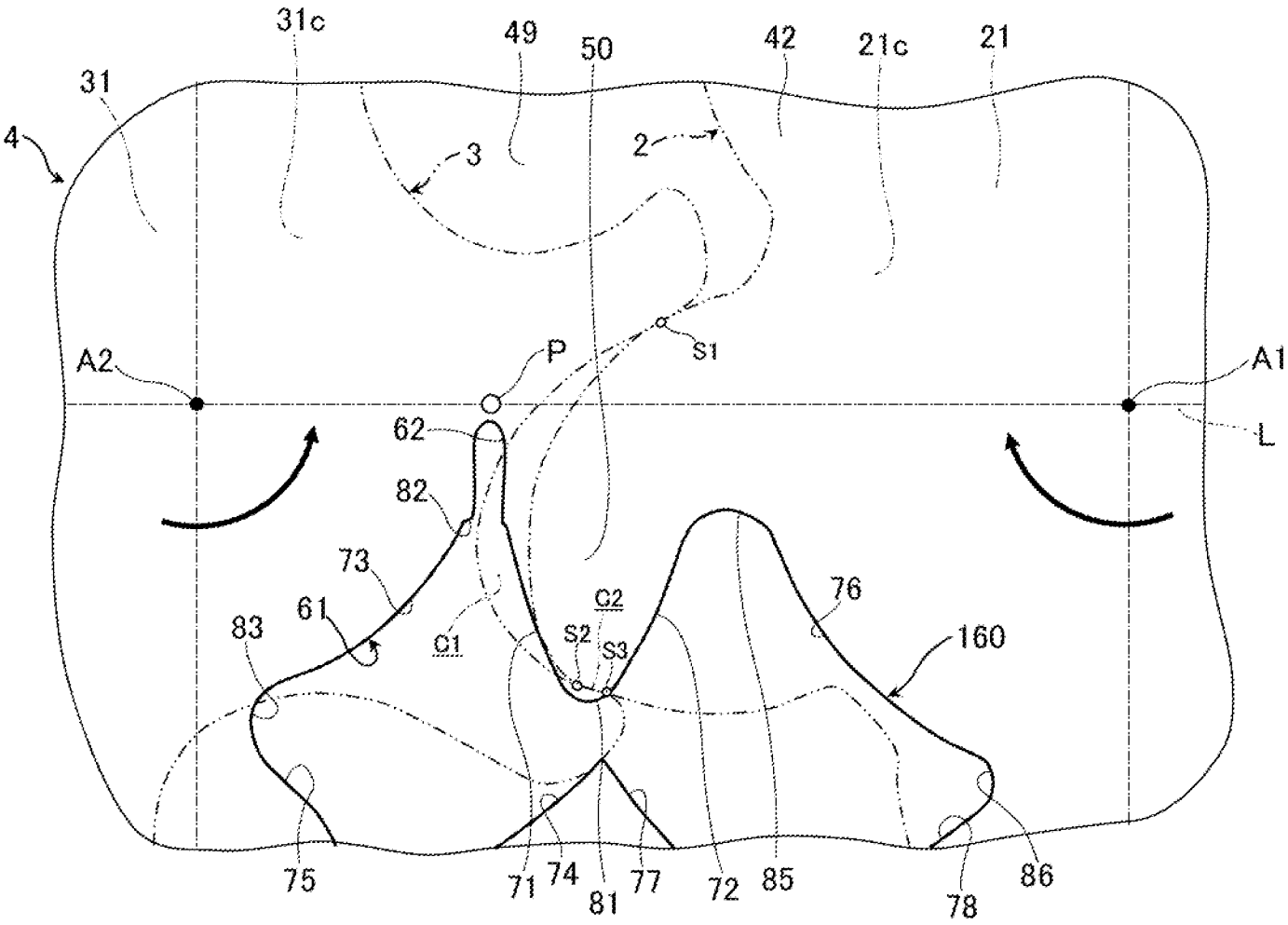
FIG. 12 is an enlarged view of a delivery port of a liquid-feeding rotary-screw compressor as a comparative example for the liquid-feeding rotary-screw compressor according to the first embodiment of the present invention.
Figure 13:
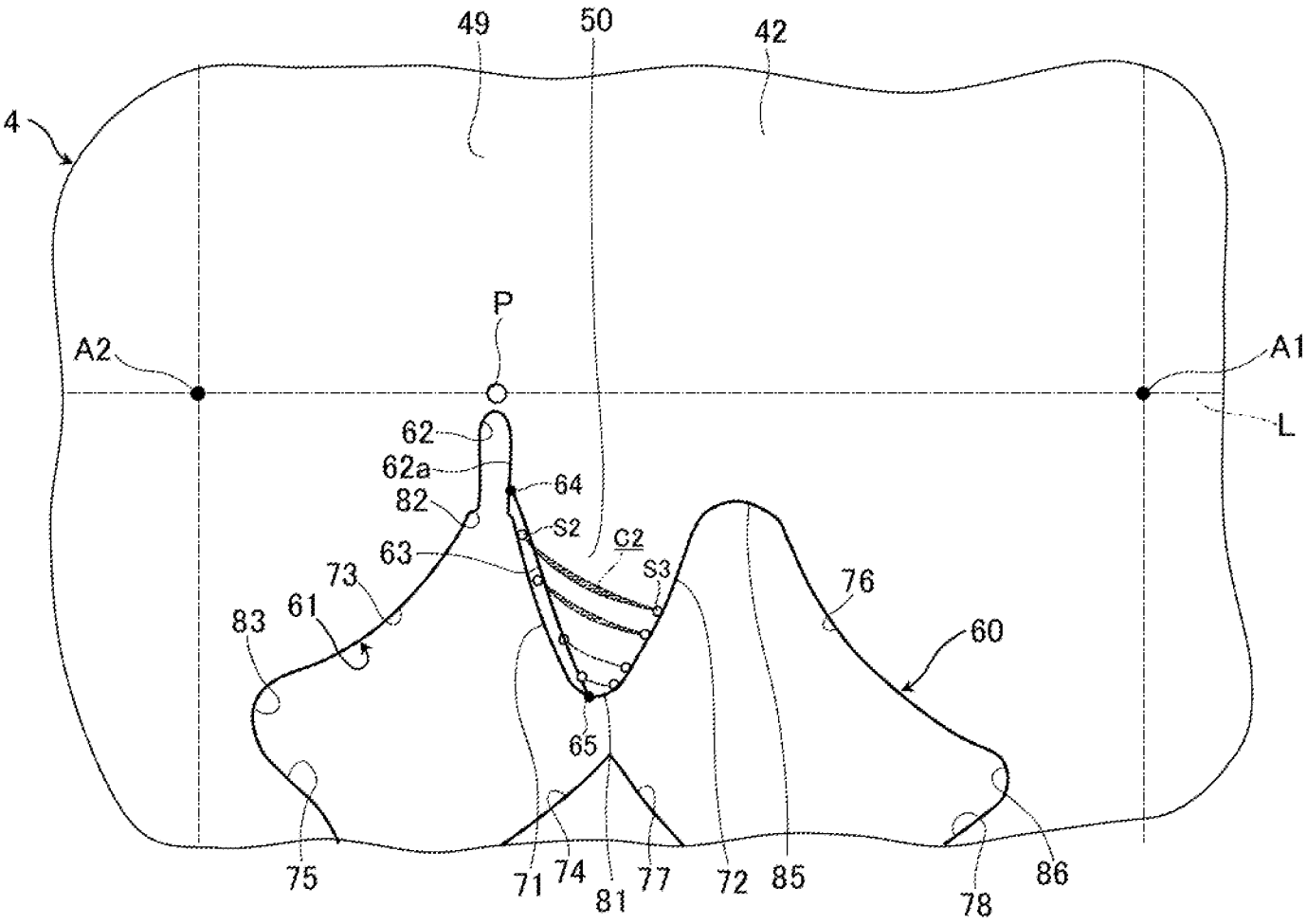
FIG. 13 is an illustration depicting communication relation between the second groove of the axial delivery port and the second working chamber in the liquid-feeding rotary-screw compressor according to the first embodiment of the present invention.
Figure 14:
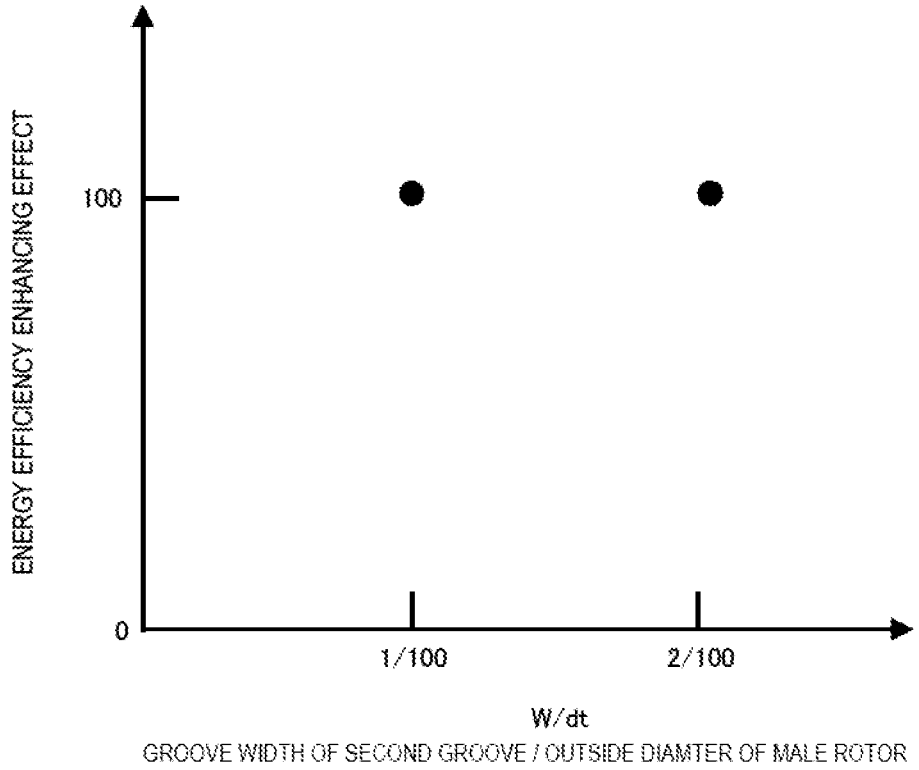
FIG. 14 is a characteristic diagram depicting the relation between the ratio of groove width of the second groove relative to the outside diameter of the male rotor and energy efficiency enhancing effect in the liquid-feeding rotary-screw compressor according to the first embodiment of the present invention.

Next, the operation and effect of the liquid-feeding rotary-screw compressor according to the first embodiment will be described, in comparison to a liquid-feeding rotary-screw compressor of a comparative example, using FIGS. 7 to 14. FIG. 12 is an enlarged view depicting a delivery port of the liquid-feeding rotary-screw compressor of the comparative example in relation to the liquid-feeding rotary-screw compressor according to the first embodiment of the present invention. FIG. 13 is an illustration depicting communication relation between the second groove of the axial delivery port and the second working chamber in the liquid-feeding rotary-screw compressor according to the first embodiment of the present invention. FIG. 14 is a characteristic diagram depicting the relation between the ratio of the groove width of the second groove relative to the outside diameter of the male rotor and an energy efficiency enhancing effect in the liquid-feeding rotary-screw compressor according to the first embodiment of the present invention. In FIG. 12, the shapes obtained by projecting the delivery ends of the male and female rotors onto the delivery inner wall surface of the casing are indicated by alternate long and two short dashes line. In addition, the thick arrows indicate rotating directions of both rotors. Note that in FIG. 12, those parts denoted by the same reference characters as the reference characters depicted in FIGS. 1 to 11 are similar parts, and detailed descriptions thereof are omitted.

In FIG. 12, the liquid-feeding rotary-screw compressor of the comparative example has an axial delivery port 160 on the delivery inner wall surface 49 of the casing 4. The axial delivery port 160 has a structure similar to that of the first opening 61 and the first groove 62 (see FIG. 7) of the axial delivery port 60 of the liquid-feeding rotary-screw compressor according to the first embodiment. However, the liquid-feeding rotary-screw compressor of the comparative example, unlike the liquid-feeding rotary-screw compressor 1 according to the first embodiment, does not have a groove corresponding to the second groove 63 (see FIG. 7) of the axial delivery port 60.

FIG. 12 depicts a rotational position where the first working chamber C1 in the delivery process (volume is maximum) and the second working chamber C2 in the suction process (volume is 0), which do not open in the radial direction but open in only the axial direction by meshing of the male and female rotors 2 and 3 on the delivery ends 21*c* and 31*c*, are initially formed (generated). In the liquid-feeding rotary-screw compressor of the comparative example, a part of the first working chamber C1 communicates directly with a part of the first opening 61 of the axial delivery port 160, and another part of the first working chamber C1 opens into a part of the first groove 62 of the axial delivery port 160 to thereby indirectly communicates with the first opening 61. This leads to secure a discharge path for the compressed gas containing the liquid within the first working chamber C1 in the delivery process. In addition, the first working chamber C1 at the final stage of the delivery process where reduction of volume has progressed, as depicted in FIG. 10, is not opening at all into the first opening 61, but a part thereof opens into the first groove 62 to thereby indirectly communicates with the first opening 61. This leads to secure a discharge path for the liquid remaining within the first working chamber C1 at the final stage of the delivery process.

When the pressure inside the first working chamber C1 was actually measured, it was confirmed that an effect of reducing the power loss of the rotary-screw compressor of the comparative example arising from nipping of the liquid by the male and female rotors 2 and 3 is obtained by the presence of the first groove 62. However, it was found that a pressure rise is still generated in the first working chamber C1 in the latter half of the delivery process. This means that, for further reducing the loss due to trapping of the liquid generated in the first working chamber C1, it is necessary and important to discharge the liquid from the initial stage at which the first working chamber C1 is formed.

On the other hand, in the liquid-feeding rotary-screw compressor 1 according to the present embodiment, as depicted in FIG. 7, the axial delivery port 60 has the first opening 61 and the first groove 62 similar in structure to the liquid-feeding rotary-screw compressor of the comparative example, and further, has the second groove 63. Therefore, at the generation stage of the first working chamber C1, like the delivery port 160 of the liquid-feeding rotary-screw compressor of the comparative example, a part of the first working chamber C1 opens directly into a part of the first opening 61, and another part of the first working chamber C1 opens into a part of the first groove 62 to thereby indirectly communicates with the first opening 61. In addition, a further part of the first working chamber C1 opens into a part of the second groove 63 to thereby indirectly communicates with the first opening 61. Because of the first working chamber C1 communicating with the first opening 61 through the second groove 63, the opening area of the first working chamber C1 communicating with the first opening 61 is increased as compared with the case of the delivery port 160 of the rotary-screw compressor of the comparative example.

As aforementioned, FIG. 8 depicts the rotational position slightly progressed from the rotational position depicted in FIG. 7 and depicts the state of the initial stage at which the first working chamber C1 and the second working chamber C2 are formed. When the rotational positions of the male and female rotors 2 and 3 progress from the positions depicted in FIG. 7 to the positions depicted in FIG. 8, the first working chamber C1 is moved toward a rotating direction side, and the crescent-shaped opening area and volume thereof are reduced simultaneously. In this instance, a part of the first working chamber C1 directly opens into a part of the first opening 61, and another part thereof opens into a part of the first groove 62 to thereby indirectly communicate with the first opening 61. In addition, a further part opens into the second groove 63 to thereby indirectly communicate with the first opening 61. Also in the first working chamber C1 depicted in FIG. 8, the communication with the first opening 61 through the second groove 63 is maintained. Therefore, the opening area of the first working chamber C1 communicating with the first opening 61 is increased as compared with the case of the delivery port 160 of the rotary-screw compressor of the comparative example.

On the other hand, when the rotational positions of the male and female rotors 2 and 3 are progressed from the positions depicted in FIG. 7 to the positions depicted in FIG. 8, the second working chamber C2 is moved toward the reference line L side, and simultaneously, the opening area thereof at the delivery ends 21*c* and 31*c* of the male and female rotors 2 and 3 is slightly increased from the state of 0 (line contact) to form a crescent-shaped opening. In this instance, the second working chamber C2 is in the state of not opening into the second groove 63.

Thus, the opening area of the first working chamber C1 relative to the axial delivery port 60 at the initial stage (see FIGS. 7 and 8) at which the first working chamber C1 is formed is increased from the case of the delivery port 160 of the rotary-screw compressor of the comparative example by the amount of the second groove 63. This causes the resistance of the liquid discharged from the first working chamber C1 to the delivery passage 52 through the axial delivery port 60 to be smaller than the case of the delivery port 160 of the rotary-screw compressor of the comparative example. Therefore, the axial delivery port 60 in the present embodiment can more easily discharge the liquid remaining within the first working chamber C1 than in the case of the delivery port 160 of the rotary-screw compressor of the comparative example. As a result, a pressure rise in the first working chamber C1 in the latter half of the delivery process is restrained, and the power loss by trapping of the liquid in the first working chamber C1 can be reduced more than in the case of the rotary-screw compressor of the comparative example.

As aforementioned, FIG. 9 depicts the rotational position progressed from the rotational position depicted in FIG. 8 and depicts the position where the flank of the delivery end 21*c* of the male rotor 2 projected onto the delivery inner wall surface 49 of the casing 4 initially reaches the side edge (side face) 62*a* on the first profile line 71 side of the first groove 62. In other words, this is a position where the flank of the delivery end 21*c* of the male rotor 2 enters the first groove 62 when the rotational positions of the male and female rotors 2 and 3 are progressed from the positions depicted in FIG. 9. In this instance, a part of the first working chamber C1 directly opens into a slight part of the first opening 61, and simultaneously, another part thereof opens into a part of the first groove 62 to thereby indirectly communicate with the first opening 61. In addition, a further slight part opens into the second groove 63 to thereby indirectly communicate with the first opening 61. The first working chamber C1 depicted in FIG. 9 is maintained in its communication with the first opening 61 through the second groove 63, but its opening area relative to the second groove 63 is slight, and an effect of reducing the resistance of the liquid can little be expected.

On the other hand, the second working chamber C2, upon progressing from the rotational position depicted in FIG. 8, moves toward the reference line L side with an increase in the opening area, and a part thereof becomes a state of opening into the second groove 63. It is to be noted, however, that since the opening area of the second working chamber C2 relative to the second groove 63 is extremely small, a lowering in energy efficiency by communication between the delivery passage 52 and the suction passage 51 through the second working chamber C2 can be restrained to a low level.

As aforementioned, FIG. 10 depicts the rotational position progressed from the rotational position depicted in FIG. 9 and depicts the state of the first working chamber C1 at the final stage of the delivery process. In other words, the first working chamber C1 is in a state of not opening directly into the first opening 61, but a part thereof opens into a part of the first groove 62 to thereby indirectly communicate with the first opening 61. This allows the liquid remaining within the first working chamber C1 to be discharged into the delivery passage 52 (see FIG. 1) through the first groove 62 even at the final stage of the delivery process at which the first working chamber C1 does not directly opens into the first opening 61.

On the other hand, the second working chamber C2 depicted in FIG. 10, upon progressing from the rotational position depicted in FIG. 9, further moves toward the reference line L side with an increase in the opening area, and comes into a state in which the opening area relative to the second groove 63 is increased. The opening area of the second working chamber C2 relative to the second groove 63 is gradually increased as the second working chamber C2 moves toward the reference line L side, as depicted in FIG. 13. However, the opening part of the second working chamber C2 relative to the second groove 63 is an end on the boundary side of the second working chamber C2 inclusive of the contact point S2, and the opening area is seen to be extremely small. Therefore, a lowering in energy efficiency of the rotary-screw compressor 1 due to communication between the delivery passage 52 and the suction passage 51 through the second working chamber C2 opening into the second groove 63 is restrained.

Note that the first working chamber C1 depicted in FIG. 10 is in the state of not opening into the second groove 63. Therefore, the second groove 63 does not function as a discharge path for the liquid remaining in the first working chamber C1 at the final stage of the delivery process. Therefore, even if the connection point of the second groove 63 relative to the first groove 62 is changed so as to approach the reference point P side more than the connection point 64 of the present configuration, an increase in the opening area of the first working chamber C1 relative to the second groove 63 at the final stage of the delivery process cannot be expected. However, on the other hand, this change leads to an increase in the opening area of the second working chamber C2 communicating with the suction passage 51 relative to the second groove 63, as depicted in FIG. 13. This promotes a lowering in the energy efficiency of the rotary-screw compressor 1 by communication between the delivery passage 52 and the suction passage 51 through the second working chamber C2. Therefore, connecting the second groove 63 to the first groove 62 at the aforementioned connection position 64 can restrain leakage loss of the compressed gas through the second working chamber C2, and a high energy efficiency of the rotary-screw compressor 1 can be maintained.

In addition, in the case of tooth specification of the male and female rotors 2 and 3 such that the degree of volume expansion of the second working chamber C2 relative to rotation of the male and female rotors 2 and 3 is small, the opening area of the second working chamber C2 relative to the second groove 63 becomes small, and thus leakage loss of the compressed gas due to communication of the second groove 63 relative to the second working chamber C2 becomes small. On the other hand, in the case of such a tooth specification, the rotational positions of the male and female rotors 2 and 3 where the first working chamber C1 opens into the second groove 63 becomes earlier, and thus the liquid remaining within the first working chamber C1 can be discharged from an early stage.

In the present embodiment, the groove width W (see FIG. 7) of the second groove 63 is configured so as to be 1/100 to 2/100 times the outside diameter (diameter of the tip circle Mdt) of the male rotor 2. According to this configuration, as depicted in FIG. 14, an energy efficiency higher than that of the rotary-screw compressor of the comparative example can be achieved. In FIG. 14, the axis of abscissas W/dt represents the ratio of the groove width of the second groove relative to the outside diameter of the male rotor, and the axis of ordinates represents a relative energy efficiency enhancing effect with the energy efficiency enhancing effect in the case where the radio W/dt is 1/100 taken as 100.

As aforementioned, the rotary-screw compressor 1 according to the first embodiment includes: the male rotor 2 having the delivery end 21*c* on the one side of the axial direction; the female rotor 3 having the delivery end 31*c* on the one side of the axial direction; and the casing 4 that has the accommodating chamber 45 and the axial delivery port 60, the accommodating chamber 45 rotatably accommodating the male rotor 2 and the female rotor 3 in a mutually meshed state, and the axial delivery port 60 being formed at the delivery inner wall surface 49 of the accommodating chamber 45 opposed to the delivery end 21*c* of the male rotor 2 and the delivery end 31*c* of the female rotor 3 and opening in the axial direction. The axial delivery port 60 includes: the first opening 61 having a profile configured to interrupt communication with the second working chamber C2 increased in volume with rotation of the male rotor 2 and the female rotor 3, of the first working chamber C1 and the second working chamber C2 which are formed by meshing of the male rotor 2 and the female rotor 3 at the delivery ends 21*c* and 31*c* and open in only the axial direction; the second opening connected to the first opening 61; and the third opening connected to the first opening 61 and the second opening. The profile of the first opening 61, when a point obtained by projecting the intersection of the reference line L passing the axis A1 of the male rotor 2 and the axis a2 of the female rotor 3, the tip circle Mdt of the male rotor 2, and the root circle Fdb of the female rotor 3 onto the delivery inner wall surface 49 is the reference point P, includes the first profile line 71 that constitutes one of the pair of lateral edges of the lingulate protrusion 50 configured to close off the second working chamber C2 and extends toward the reference point P; the second profile line 72 constituting the other of the pair of lateral edges of the protrusion 50; the first connection line 81 that constitutes the tip edge of the protrusion 50 and connects the first profile line 71 and the second profile line 72 to each other; the third profile line 73 extending toward the reference point P along a part of a curve obtained by projecting the root circle Fdb of the female rotor 3 onto the delivery inner wall surface 49; and the second connection line 82 connecting the first profile line 71 and the third profile line 73 to each other. The second opening includes the first groove 62 formed on the delivery inner wall surface 49 so as to open into the first opening 61 at the position of the second connection line 82 and to extend from the position of the second connection line 82 toward the reference line L in a range not to exceed the reference line L. The third opening includes the second groove 63 formed on the delivery inner wall surface 49 so as to have one-side end opening into the first groove 62, to open into the first opening 61 at the position of the first profile line 71, and to extend along the first profile line 71.

According to this configuration, the axial delivery port 60 includes the second groove 63 that opens into the first working chamber C1 decreasing in volume from the initial stage of formation of the first working chamber C1, and this allows a further discharge of the liquid from the first working chamber C1 through the second groove 63 in the initial stage of formation of the first working chamber C1, and can restrain a pressure rise in the first working chamber C1. In addition, since the second groove 63 is configured so as to extend along the first profile line 71 of the first opening 61 having a profile configured to interrupt communication with the second working chamber C2 communicating with the suction space (suction passage 51), the opening area of the second working chamber C2 relative to the second groove 63 can be suppressed to be small. Therefore, this configuration can achieve both a reduction in power loss arising from the trapping of the liquid by the male and female rotors 2 and 3 in the delivery process and restraint of communication between the delivery space and the suction space.

In addition, in the present embodiment, the second groove 63 is configured so as to extend over the whole of the first profile line 71. According to this configuration, even in the state in which only a part of the first working chamber C1 is opening into the second groove 63, the liquid having passed from the first working chamber C1 through an opening at a part of the second groove 63 is discharged to the first opening 61 from the whole length of the second groove 63. Therefore, as compared to the case where the second groove 63 extends only to an intermediate position of the first profile line 71, this configuration can reduce the resistance to discharge of the liquid at the axial delivery port 60.

Besides, in the present embodiment, the connection position 64 which is a part of the connection of the second groove 63 to the first groove 62 and is closest to the reference line L is set so as to be a position of the side edge that the flank of the delivery end 21*c* of the male rotor 2 projected onto the delivery inner wall surface 49 initially reaches by rotation, of the side edges 62*a* of the first groove 62. According to this configuration, an opening area of the first working chamber C1 at the initial stage of formation relative to the second groove 63 can be secured, and on the other hand, the opening area of the second working chamber C2 relative to the second groove 63 can be suppressed to be small. Therefore, a reduction in power loss arising from nipping of the liquid by the male and female rotors 2 and 3 and restraint of leakage loss of the compressed gas through the second working chamber C2 can be achieved, and a high energy efficiency of the rotary-screw compressor 1 can be maintained.

In addition, in the present embodiment, the first profile line 71 of the first opening 61 is configured so as to extend toward the reference point P along a part of a curve obtained by projecting the tip circle Mdt of the male rotor 2 onto the delivery inner wall surface 49. According to this configuration, the first profile line 71 is located on the outer side of the second working chamber C2 relative to a curve obtained by projecting the locus of the contact point S2 which is the boundary between the first working chamber C1 and the second working chamber C2 onto the delivery inner wall surface 49 of the casing 4, and therefore, the opening area of the second groove 63 extending along the first profile line 71 relative to the second working chamber C2 can be suppressed to be small.

Second Embodiment

Figure 15:
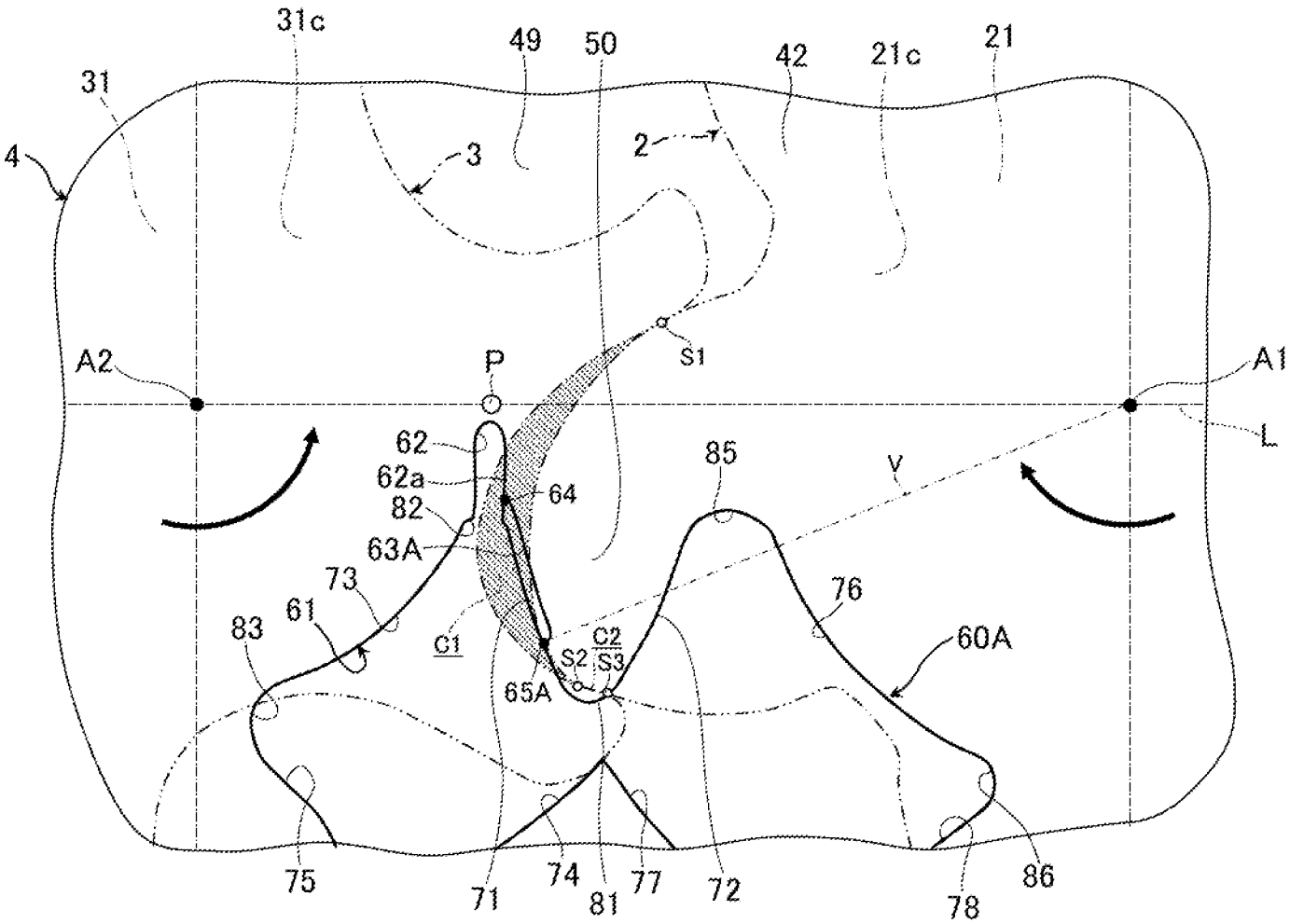
FIG. 15 is an enlarged view depicting an axial delivery port in a liquid-feeding rotary-screw compressor according to a second embodiment of the present invention.

Next, a liquid-feeding rotary-screw compressor according to a second embodiment will be exemplified and described using FIG. 15. FIG. 15 is an enlarged view depicting an axial delivery port in the liquid-feeding rotary-screw compressor according to the second embodiment of the present invention. Note that in FIG. 15, the parts denoted by the same reference characters as the reference characters depicted in FIGS. 1 to 14 are similar parts, and detailed descriptions thereof are omitted.

The liquid-feeding rotary-screw compressor according to the second embodiment depicted in FIG. 15 differs from the liquid-feeding rotary-screw compressor (see FIG. 7) of the first embodiment in that a second groove 63A of an axial delivery port 60A is configured so as to extend from the first groove 62 only to an intermediate position of the first profile line 71. Specifically, the second groove 63A has one-side end connected to the first groove 62 at the connection position 64, like the first embodiment. On the other hand, the second groove 63A has an other-side end at an intermediate position along the first profile line 71. The intermediate position is an intersection of the first profile line 71 with a line obtained by projecting a line segment V, which connects a lobe tip of the delivery end 21*c* of the male rotor 2 to the axis A1 of the male rotor 2 at a rotational position where the first working chamber C1 in the delivery process and the second working chamber C2 in the suction process start to be formed (are just generated), onto the delivery inner wall surface 49 of the casing 4, as a connection position 65A. This connection position 65A has a concept including the intersection of the first profile line 71 with the line obtained by projecting the line segment V onto the delivery inner wall surface 49 of the casing 4, and the vicinity of the intersection, specifically, a range on the order of the groove width of the second groove 63A from the intersection.

FIG. 15 depicts a rotational position where the first working chamber C1 in the delivery process and the second working chamber C2 in the suction process start to be formed. In FIG. 15, the connection position 65A of the other-side end of the second groove 63A with the first profile line 71 coincides with the position of a lobe tip of the delivery end 21*c* of the male rotor 2.

According to the aforementioned second embodiment, like the first embodiment, the axial delivery port 60A includes the second groove 63A that opens into the first working chamber C1 decreasing in volume from the initial stage of formation of the first working chamber C1, and this allows a further discharge of the liquid from the first working chamber C1 through the second groove 63A at the initial stage of formation of the first working chamber C1, and can restrain a pressure rise in the first working chamber C1. In addition, since the second groove 63A is configured so as to extend along the first profile line 71 of the first opening 61 having a profile configured to interrupt communication with the second working chamber C2 communicating with the suction space (suction passage 51), the opening area of the second working chamber C2 relative to the second groove 63A can be suppressed to be small. Therefore, this configuration can achieve both a reduction in power loss arising from trapping of the liquid by the male and female rotors 2 and 3 in the delivery process and restraint of communication between the delivery space and the suction space.

In addition, in the present embodiment, the second groove 63A is configured so as to extend from the first groove 62 to an intermediate position of the first profile line 71. According to this configuration, it is possible to retard the start of opening of the second groove 63A into the second working chamber C2. Besides, in the case of tooth specification of the male and female rotors 2 and 3 in which the degree of volume expansion of the second working chamber C2 relative to rotation of the male and female rotors 2 and 3 is large, the opening area of the second working chamber C2 relative to the second groove 63A becomes small, and thus leakage loss of the compressed gas due to opening of the second groove 63A relative to the second working chamber C2 can be suppressed to be smaller than that in the case of the first embodiment. Therefore, a high energy efficiency of the rotary-screw compressor 1 can be maintained.

Further, in the present embodiment, the second groove 63A is configured such that the intermediate position of the first profile line 71 to which the second groove 63A extends is the intersection 65A of the first profile line 71 with a projection of the line segment V onto the delivery inner wall surface 49 of the casing 4. The line segment V connects the axis A1 of the male rotor 2 with a lobe tip of the delivery end 21*c* of the male rotor 2 at the rotational position where the first working chamber C1 and the second working chamber C2 start to be formed. According to this configuration, the start of opening of the second groove 63A into the second working chamber C2 can be securely retarded. Therefore, the opening area of the second working chamber C2 relative to the second groove 63A can be securely suppressed to be small, and leakage loss of the compressed gas due to opening of the second groove 63A relative to the second working chamber C2 can be securely suppressed to be small.

Other Embodiments

Note that the present invention is not limited to the aforementioned embodiments, and includes various modifications. The aforementioned embodiments have been described in detail for easily understandably describing the present invention, and are not limited to those necessarily including all the configurations described. In other words, a part of the configuration of a certain embodiment may be replaced by the configuration of other embodiment, and to the configuration of a certain embodiment, the configuration of other embodiment may be added. Besides, in regard of a part of each embodiment, addition of other configuration, deletion, or replacement with other configuration may be performed.

For example, in the aforementioned first and second embodiments, an example in which the profile of the first opening 61 of the axial delivery ports 60 and 60A is configured so as to include the first profile line 71 extending toward the reference point P along a part of a curve obtained by projecting the tip circle Mdt of the male rotor 2 onto the delivery inner wall surface 49 of the casing 4 has been shown. However, the first profile line 71 may be configured so as to extend toward the reference point P along a part of a curve obtained by projecting the locus of the contact point S2, which is a boundary between the first working chamber C1 and the second working chamber C2, of the three contact points S1, S2, and S3 generated by meshing of the male and female rotors 2 and 3 on the delivery ends 21*c* and 31*c*, onto the delivery inner wall surface 49 of the casing 4. In addition, the first profile line 71 may be configured as a curve based on both the curve obtained by projecting the tip circle Mdt of the male rotor 2 onto the delivery inner wall surface 49 of the casing 4 and the curve obtained by projecting the locus of the contact point S2 onto the delivery inner wall surface 49 of the casing 4, or a curve approximate to the curve.

Besides, in the present embodiment, an example in which the profile of the first opening 61 includes the second profile line 72 extending along a curve obtained by projecting the locus of the contact point S3, which is a boundary on the other side of the second working chamber C2, of the three contact points S1, S2, and S3 generated by meshing of the male and female rotors 2 and 3 on the delivery ends 21*c* and 31*c*, onto the delivery inner wall surface 49 of the casing 4, has been shown. However, the second profile line 72 may be configured as a curve or a polygonal line approximate to the curve obtained by projecting the locus of the contact point S3 onto the delivery inner wall surface 49 of the casing 4.

In addition, in the present embodiment, an example in which the profile of the first opening 61 includes: the third profile line 73 extending toward the reference point P along a part of a curve obtained by projecting the root circle Fdb of the female rotor 3 onto the delivery inner wall surface 49 of the casing 4; the fourth profile line 74 that extends along a part of a curve obtained by projecting the second inner circumferential surface 47 on the side of the female rotor 3 of the accommodating chamber 45 onto the delivery inner wall surface 49 of the casing 4 and that is opposed to the third profile line 73; and the fifth profile line 75 extending along a curve obtained by projecting the shape of the leading flank of the delivery end 31*c* of the female rotor 3 onto the delivery inner wall surface 49 of the casing 4, has been shown. It is to be noted, however, that the third profile line 73 is defined as a concept including a curve or a polygonal line approximate to the curve obtained by projecting the root circle Fdb of the female rotor 3 onto the delivery inner wall surface 49 of the casing 4. Similarly, the fourth profile line 74 is defined as a concept including a curve or a polygonal line approximate to the curve obtained by projecting the second inner circumferential surface 47 on the female rotor 3 side of the accommodating chamber 45 onto the delivery inner wall surface 49 of the casing 4. Similarly, the fifth profile line 75 is defined as a concept including a curve or a polygonal line approximate to the curve obtained by projecting the shape of the leading flank of the delivery end 31*c* of the female rotor 3 onto the delivery inner wall surface 49 of the casing 4.

Besides, in the present embodiment, an example in which the profile of the first opening 61 includes: the sixth profile line 76 extending along a part of a curve obtained by projecting the root circle Mdb of the male rotor 2 onto the delivery inner wall surface 49 of the casing 4; the seventh profile line 77 that extends along a part of a curve obtained by projecting the first inner circumferential surface 46 on the male rotor 2 side of the accommodating chamber 45 onto the delivery inner wall surface 49 of the casing 4 and that is opposed to the sixth profile line 76; and the eighth profile line 78 extending along a curve obtained by projecting the shape of the trailing flank of the delivery end 21*c* of the male rotor 2 onto the delivery inner wall surface 49 of the casing 4, has been shown. It is to be noted, however, that the sixth profile line 76 is defined as a concept including a curve or a polygonal line approximate to the curve obtained by projecting the root circle Mdb of the male rotor 2 onto the delivery inner wall surface 49 of the casing 4. Similarly, the seventh profile line 77 is defined as a concept including a curve or a polygonal line approximate to the curve obtained by projecting the first inner circumferential surface 46 on the male rotor 2 side of the accommodating chamber 45 onto the delivery inner wall surface 49 of the casing 4. Similarly, the eighth profile line 78 is defined as a concept including a curve or a polygonal line approximate to the curve obtained by projecting the shape of the trailing flank of the delivery end 21*c* of the male rotor 2 onto the delivery inner wall surface 49 of the casing 4.

In addition, in the present embodiment, an example in which the first connection line 81 includes an arc or a curve has been shown, but the first connection line may include a straight line.

Besides, in the present embodiment, an example in which the male and female rotors 2 and 3 are configured such that the flanks of the male and female rotors 2 and 3 on the delivery ends 21*c* and 31*c* make line contact with each other between the second contact point S2 and the third contact point S3 constituting both ends of the second working chamber C2, at a rotational position where the second working chamber C2 is initially formed by meshing of the male and female rotors 2 and 3 on the delivery ends 21*c* and 31*c*, has been shown. However, at a rotational position where the second working chamber C2 is initially formed by meshing of the male and female rotors 2 and 3 on the delivery ends 21*c* and 31*c*, the flanks of the male and female rotors 2 and 3 on the delivery ends 21*c* and 31*c* may be configured such that the second contact point S2 and the third contact point S3 constituting both ends of the second working chamber C2 coincide with each other.

In addition, in the present embodiment, an example of a constitution in which the delivery passage 52 has only the axial delivery port 60 opening in the axial direction has been shown. However, the delivery passage may be configured so as to have a radial delivery port opening in the radial direction, in addition to the axial delivery port 60.

DESCRIPTION OF REFERENCE CHARACTERS

1: Liquid-feeding rotary-screw compressor
2: Male rotor
3: Female rotor
4: Casing
21*c*: Delivery end
31*c*: Delivery end
45: Accommodating chamber
49: Delivery inner wall surface
50: Protrusion
60, 60A: Axial delivery port (delivery port)
61: First opening
62: First groove
63, 63A: Second groove
64: Connection position (position)
65A: Connection position (intermediate position)
71: First profile line
72: Second profile line
73: Third profile line
81: First connection line
82: Second connection line
A1: Axis
A2: Axis
C1: First working chamber C2: Second working chamber
L: Reference line
P: Reference point
W: Groove width
Fdb: Root circle of male rotor
Mdt: Tip circle of male rotor

The invention claimed is:

1. A liquid-feeding rotary-screw compressor comprising:
a male rotor having a delivery end on one side in an axial direction;
a female rotor having a delivery end on the one side in the axial direction; and
a casing having an accommodating chamber that rotatably accommodates the male rotor and the female rotor in a mutually meshed state, and a delivery port that opens in the axial direction and is formed at a delivery inner wall surface of the accommodating chamber, the delivery inner wall surface being opposed to the delivery end of the male rotor and the delivery end of the female rotor, wherein
a first working chamber and a second working chamber that open only in the axial direction are formed by meshing of the male rotor and the female rotor at the delivery ends,
the delivery port includes:
a first opening having a profile configured to interrupt communication with the second working chamber of the first working chamber and the second working chamber, the second working chamber being increased in volume with rotation of the male rotor and the female rotor;
a second opening connected to the first opening; and
a third opening connected to the first opening and the second opening,
the profile of the first opening includes:
when a point obtained by projecting an intersection of a reference line passing through an axis of the male rotor and an axis of the female rotor, a tip circle of the male rotor, and a root circle of the female rotor onto the delivery inner wall surface is made to be a reference point,
a first profile line that constitutes one of a pair of lateral edges of a lingulate protrusion configured to close off the second working chamber and that extends toward the reference point;
a second profile line that constitutes another one of the pair of lateral edges of the lingulate protrusion;
a first connection line that constitutes a tip edge of the lingulate protrusion and connects the first profile line and the second profile line to each other;
a third profile line that extends toward the reference point along a part of a curve obtained by projecting the root circle of the female rotor onto the delivery inner wall surface; and
a second connection line that connects the first profile line and the third profile line to each other,
the second opening includes a first groove formed on the delivery inner wall surface, the first groove opening into the first opening at a position of the second connection line and extending from the position of the second connection line toward the reference line in such a range as not to exceed the reference line, and
the third opening includes a second groove formed on the delivery inner wall surface, the second groove having a one-side end portion opening into the first groove, opening into the first opening at a position of the first profile line, and extending along the first profile line.

2. The liquid-feeding rotary-screw compressor according to claim 1, wherein
the second groove is configured so as to extend over a whole of the first profile line.

3. The liquid-feeding rotary-screw compressor according to claim 1, wherein
the second groove is configured so as to extend to an intermediate position of the first profile line.

4. The liquid-feeding rotary-screw compressor according to claim 3, wherein
the intermediate position to which the second groove extends is an intersection of the first profile line with a projection of a line segment onto the delivery inner wall surface, the line segment being one connecting the axis of the male rotor to a lobe tip of the delivery end of the male rotor at a rotational position where the first working chamber and the second working start to be formed.

5. The liquid-feeding rotary-screw compressor according to claim 1, wherein
a position of a part of a connection of the second groove to the first groove, the part being nearest to the reference line, is set so as to be a position of side edges of the first groove, the position of the side edges being one that a leading flank of the delivery end of the male rotor, in respective to a rotation direction, projected onto the delivery inner wall surface initially reaches by rotation.

6. The liquid-feeding rotary-screw compressor according to claim 1, wherein
the second groove has a groove width of 1/100 to 2/100 times an outside diameter of the tip circle of the male rotor.

7. The liquid-feeding rotary-screw compressor according to claim 1, wherein
the first profile line is configured so as to extend toward the reference point along a part of a curve obtained by projecting the tip circle of the male rotor onto the delivery inner wall surface.

* * * * *